US010637186B2

(12) United States Patent
Urtz, Jr.

(10) Patent No.: US 10,637,186 B2
(45) Date of Patent: Apr. 28, 2020

(54) HYBRID FEED-THROUGH CONNECTOR FOR COAXIAL CABLES

(71) Applicant: John Mezzalingua Associates, LLC, Liverpool, NY (US)

(72) Inventor: Thomas Sawyer Urtz, Jr., North Syracuse, NY (US)

(73) Assignee: John Mezzalingua Associates, LLC, Liverpool, NY (US)

( * ) Notice: Subject to any disclaimer, the term of this patent is extended or adjusted under 35 U.S.C. 154(b) by 316 days.

(21) Appl. No.: 15/624,225

(22) Filed: Jun. 15, 2017

(65) Prior Publication Data

US 2018/0006420 A1 Jan. 4, 2018

Related U.S. Application Data

(60) Provisional application No. 62/356,203, filed on Jun. 29, 2016.

(51) Int. Cl.

| | |
|---|---|
| ***H01R 13/622*** | (2006.01) |
| ***H01R 24/52*** | (2011.01) |
| *H01R 103/00* | (2006.01) |
| *H01R 24/56* | (2011.01) |

(52) U.S. Cl.

CPC ..... *H01R 13/622* (2013.01); *H01R 24/525* (2013.01); *H01R 24/564* (2013.01); *H01R 2103/00* (2013.01)

(58) Field of Classification Search

CPC ..... H01R 24/564; H01R 13/622

See application file for complete search history.

(56) References Cited

U.S. PATENT DOCUMENTS

| | | | | |
|---|---|---|---|---|
| 5,984,723 | A * | 11/1999 | Wild | H01R 9/0524 439/583 |
| 6,293,824 | B1 * | 9/2001 | Guerin | H01R 24/564 439/583 |
| 9,385,446 | B2 * | 7/2016 | Palinkas | H01R 9/0527 |
| 9,941,609 | B2 * | 4/2018 | Paynter | H01R 9/0521 |
| 2005/0239327 | A1 * | 10/2005 | Cantz | H01R 13/03 439/578 |

* cited by examiner

*Primary Examiner* — Tho D Ta

(74) *Attorney, Agent, or Firm* — Barclay Damon LLP

(57) ABSTRACT

A connector for mechanically and electrically coupler a coaxial cable to a port which minimizes the component parts to enhance reliability and reduce cost without sacrificing performance. The connector includes a sleeve operative to engage the outer conductor of the coaxial cable while a coupler is configured to effect relative displacement of the coaxial cable and interface port. The sleeve and coupler each include aligned bores for receiving the coaxial cable which presents a center conductor pin and a collapsible outer conductor toward the interface port. As the coaxial cable is axially displaced toward the port, the center conductor pin engages a socket of the port while an annular compression surface of the port simultaneously engages an annular outer conductor edge of the port, collapsing the outer conductor against the port to enhance electrical conductivity and RF performance.

10 Claims, 18 Drawing Sheets

HYBRID FEED-THROUGH CONNECTOR FOR COAXIAL CABLES

CROSS-REFERENCE TO RELATED APPLICATIONS

This application is a non-provisional of, and claims the benefit and priority of, U.S. Provisional Patent Application No. 62/356,203, filed on Jun. 29, 2016. The complete specification of such application is hereby incorporated by reference in its entirety.

BACKGROUND

Coaxial cable is a typical transmission medium used in communications networks, such as a CATV network. The cables which make up the transmission portion of the network are typically of the "hard-line" variety, while those used to distribute the signals into residences and businesses are typically "drop-line" connectors. A principal difference between hard- and drop-line cables relate to the material composition of the conductive outer conductor. More specifically, hard-line cables include a rigid or semi-rigid outer conductor covered by a weather protecting outer jacket which prevents radiation leakage and protects the inner conductor and core dielectric. Furthermore, the rigidity of the outer conductor enables large straight-line distances to be spanned by hard-line cables. Drop-line cables include a relatively flexible, braided outer conductor that permits bending around obstacles located between the transition/junction box and the television, computer, DVR, and the like. Due to the differences in size, material composition, and performance associated with hard- and drop-line cables, there are different technical considerations involved in the design of the connectors used in conjunction with such cables.

When constructing and maintaining a cable network, the transmission cables are often interconnected by electrical equipment which "conditions" the signal being transmitted. Such electrical equipment is typically housed in a box that may be located outside on a pole, or the like, or underground that is accessible through a cover. In either event, the boxes have standard ports to which the transmission cables may be connected. In order to maintain the electrical integrity of the signal, it is critical that the transmission cable be securely interconnected to the port without disrupting the ground connection of the cable. This requires a skilled technician to effect the interconnection.

Currently, when using a commercially available three piece connector, it is not practical to secure the connector to the outer conductor of the cable prior to securing the front and back portions of the connector to one another. To do so would prevent the portion secured to the cable from turning freely, thus preventing it being easily threaded onto the portion secured in the line equipment (taps, amplifiers, etc.). Instead, the installer holds the cable firmly butted to the connector while tightening the two portions of the connector together; otherwise, the center conductor seizure mechanism may secure the center conductor in the wrong position (leading to inadequate cable retention and electrical connection). It will be appreciated that holding the cable portions together while manipulating two wrenches simultaneously, can be difficult. In addition, it is typically not possible to disconnect the cable from the line equipment without first releasing the cable from the connector, thus breaking what might otherwise have been a good connection in order to perform service or testing. Often, in order to ensure a good connection when reinstalled, it is standard practice to cut and re-prepare the cable, which eventually shortens the cable to the point where a section of additional cable needs to be added or spliced-together.

In addition to the difficulties associated with manipulating multiple parts or components of hard-line connectors, the number of components adversely impacts the cost and complexity of the connector. A connector, whether it is a hard-line or conventional F-type drop-line, connector, typically includes: (i) an outer connector body, (2) an inner post, (3) a threaded coupler, (4) an inner conductor engager, (5) an insulating/centering member, (6) a multi-fingered compression ring/external fastener; (7) a continuity member, and (8) outer conductor engager. Consequently, a typical connector requires at least eight (8) separate components to make a viable mechanical and electrical connection between a coaxial cable and an interface port. Inasmuch as the market for connectors is highly competitive/cost sensitive, the elimination/deletion of even a single element/component can be the difference between being selected as a network supplier or being eliminated from a market in its entirety. This is due to the fact that even a faction of a penny (i.e., in savings) can translate into millions of dollars when considering the billions of connections which will be made. The elimination of several components by a manufacturer can result in sweeping changes in a market, i.e., a complete retrofit of existing devices with a less expensive connector.

Therefore, there is a need to overcome, or otherwise lessen the effects of, the disadvantages and shortcomings described above

SUMMARY

A connector is provided for mechanically and electrically coupler a coaxial cable to a port which minimizes the component parts to enhance reliability and reduce cost without sacrificing performance. The connector includes a sleeve operative to engage the outer conductor of the coaxial cable while the coupler is configured to effect relative displacement of the coaxial cable and interface port. The sleeve and the coupler each include aligned bores for receiving the coaxial cable which presents a center conductor pin and a collapsible outer conductor to the interface port. As the coaxial cable is axially displaced toward the port, the center conductor pin engages a socket of the port while an annular compression surface of the port simultaneously engages an annular outer conductor edge of the port, collapsing the outer conductor against the port to enhance electrical conductivity and RF performance.

Axial displacement of the coaxial cable is effected by a threaded interface between the coupler and the port. More specifically, the sleeve engages a corrugated outer conductor surface or a "spiral-superflex" outer conductor surface and includes an outwardly projecting flange for engaging an inwardly projecting flange of the coupler. Rotation of the coupler effects axial displacement of the sleeve and coaxial cable toward the interface port. The axial displacement draws the inner conductor pin and the corrugated/spiral outer conductor into engagement with an inner conductor receptacle and an annular compression surface of the interface port.

As such, the relative displacement of the interface port and the coupler causes the annular compression surface to engage, and axially deform, the outer conductor thereby effecting an electrical ground from the outer conductor to the port body while, at the same time, effecting a reliable and secure connection between an RF signal-carrying inner conductor and the inner conductor receptacle of the interface port. Additional features and advantages of the present disclosure are described in, and will be apparent from, the following Brief Description of the Drawings and Detailed Description.

BRIEF DESCRIPTION OF THE DRAWINGS

Additional features and advantages of the present disclosure are described in, and will be apparent from, the following Brief Description of the Drawings and Detailed Description.

BRIEF DESCRIPTION OF THE DRAWINGS

Figure 1:
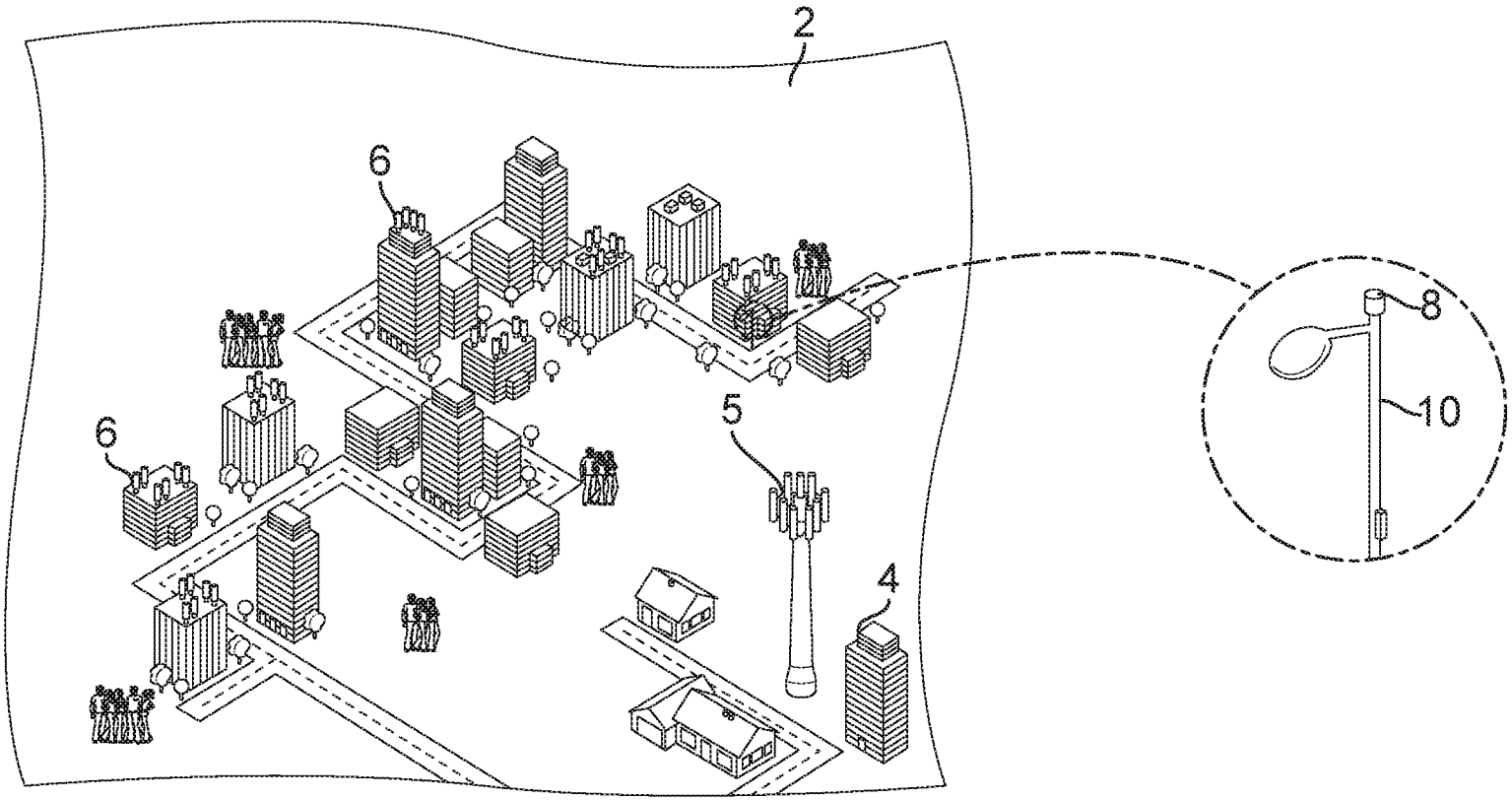

FIG. 1 is a schematic diagram illustrating an example of one embodiment of an outdoor wireless communication network.

Figure 2:
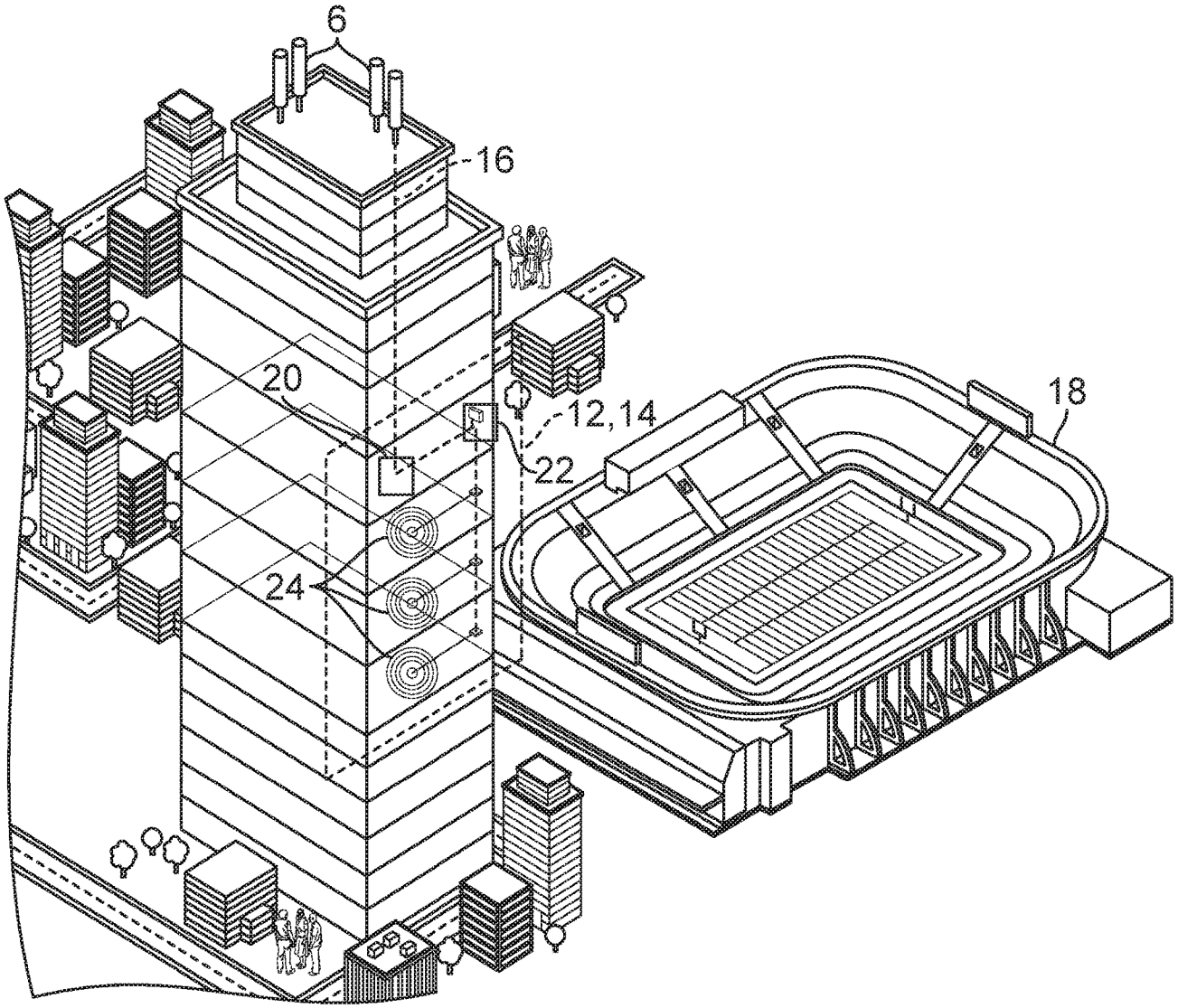

FIG. 2 is a schematic diagram illustrating an example of one embodiment of an indoor wireless communication network.

Figure 3:
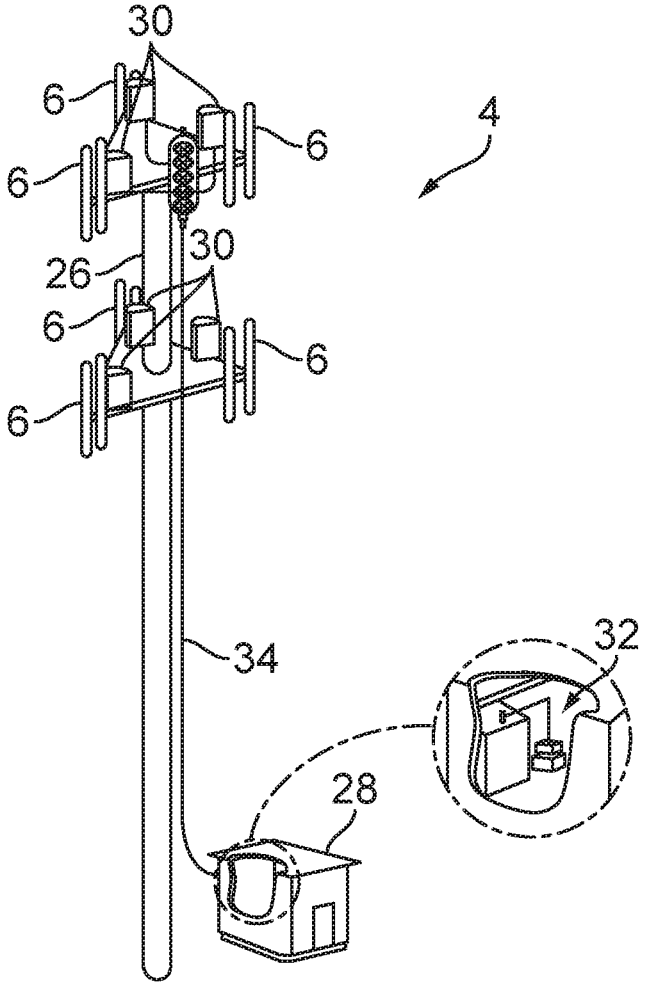

FIG. 3 is an isometric view of one embodiment of a base station illustrating a tower and ground shelter.

Figure 4:
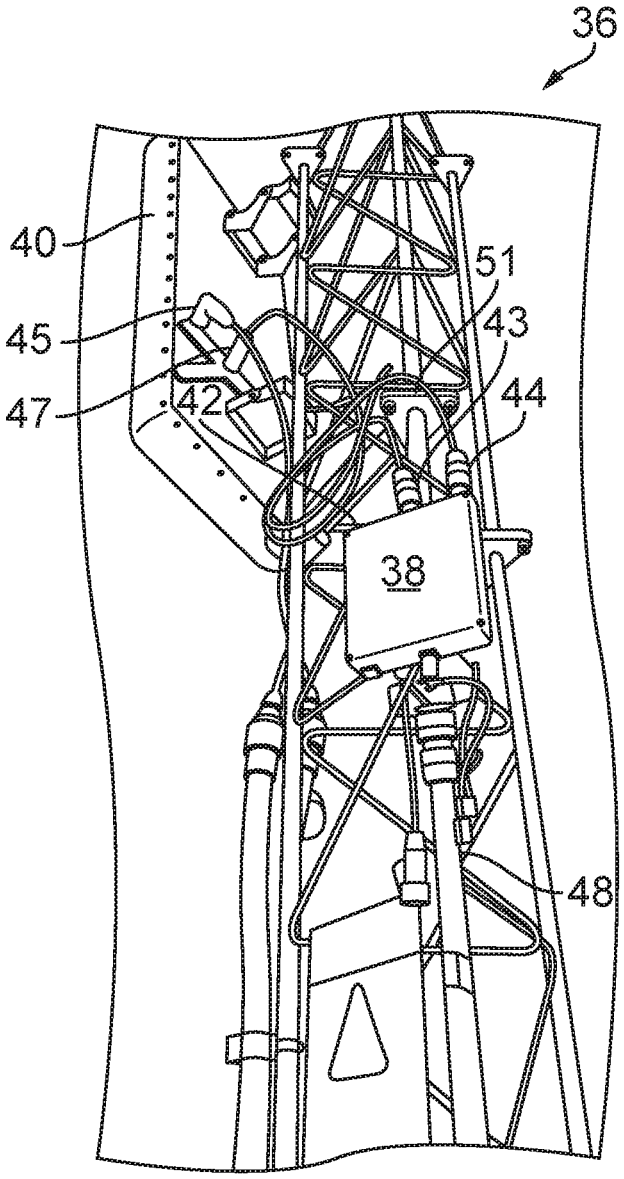

FIG. 4 is an isometric view of one embodiment of a tower.

Figure 5:
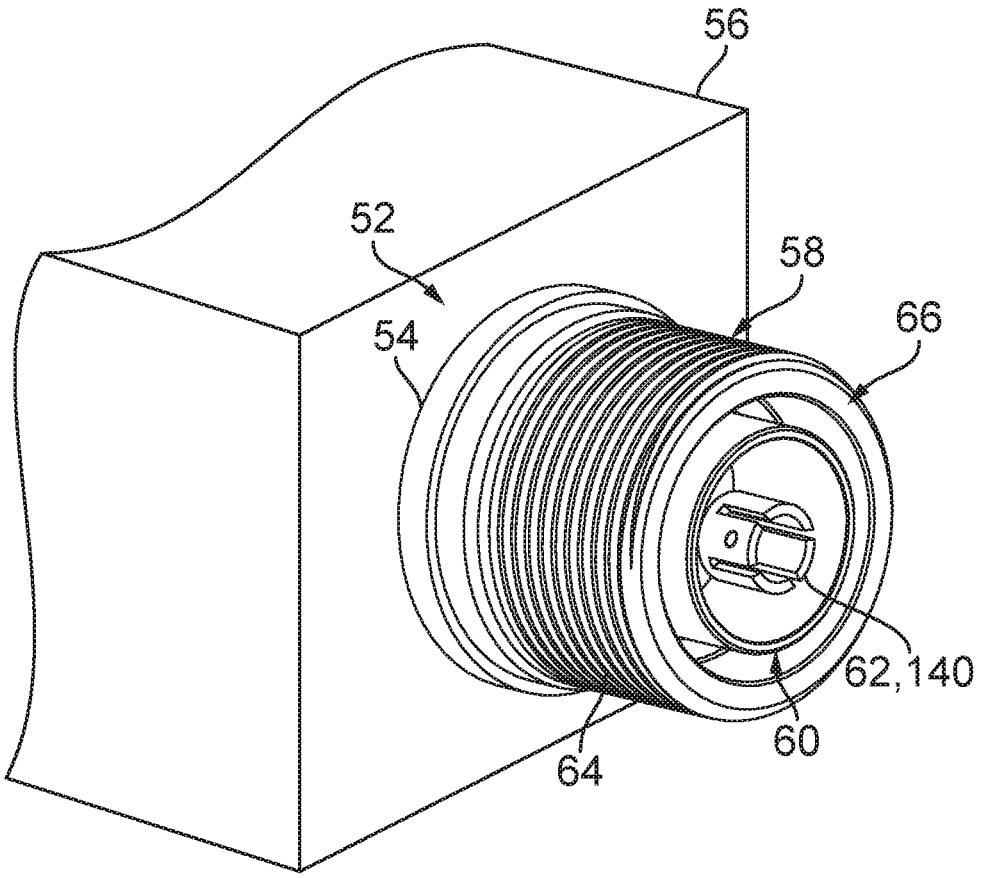

FIG. 5 is an isometric view of one embodiment of an interface port.

Figure 6:
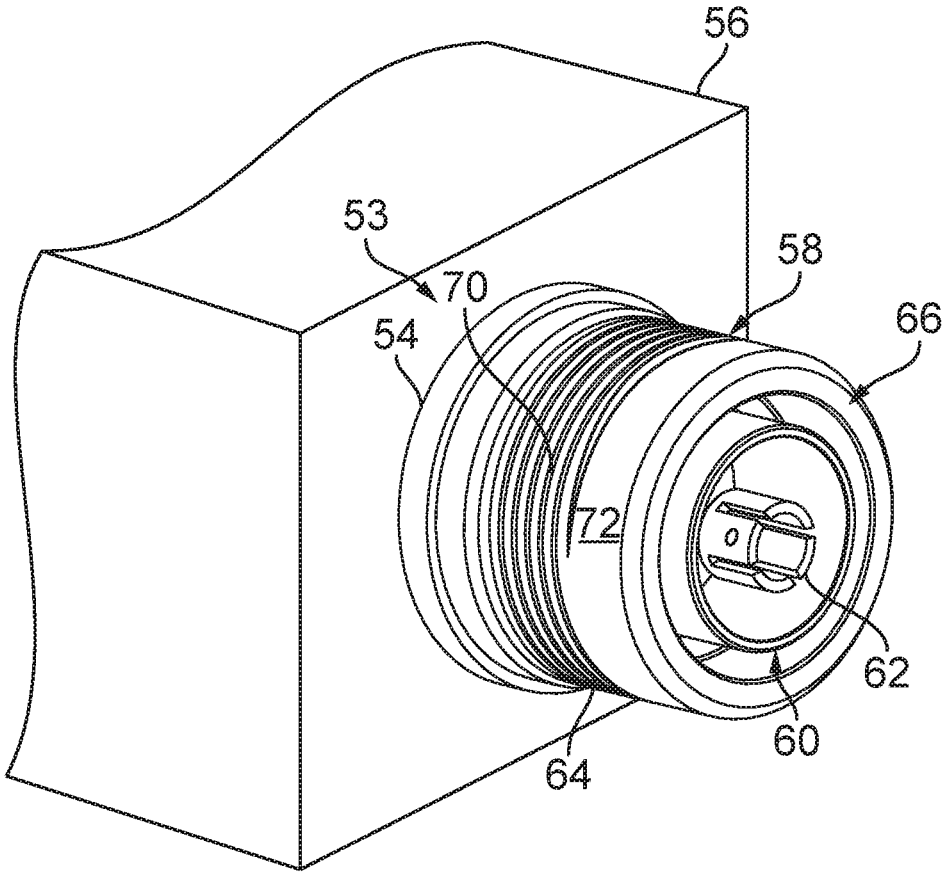

FIG. 6 is an isometric view of another embodiment of an interface port.

Figure 7:
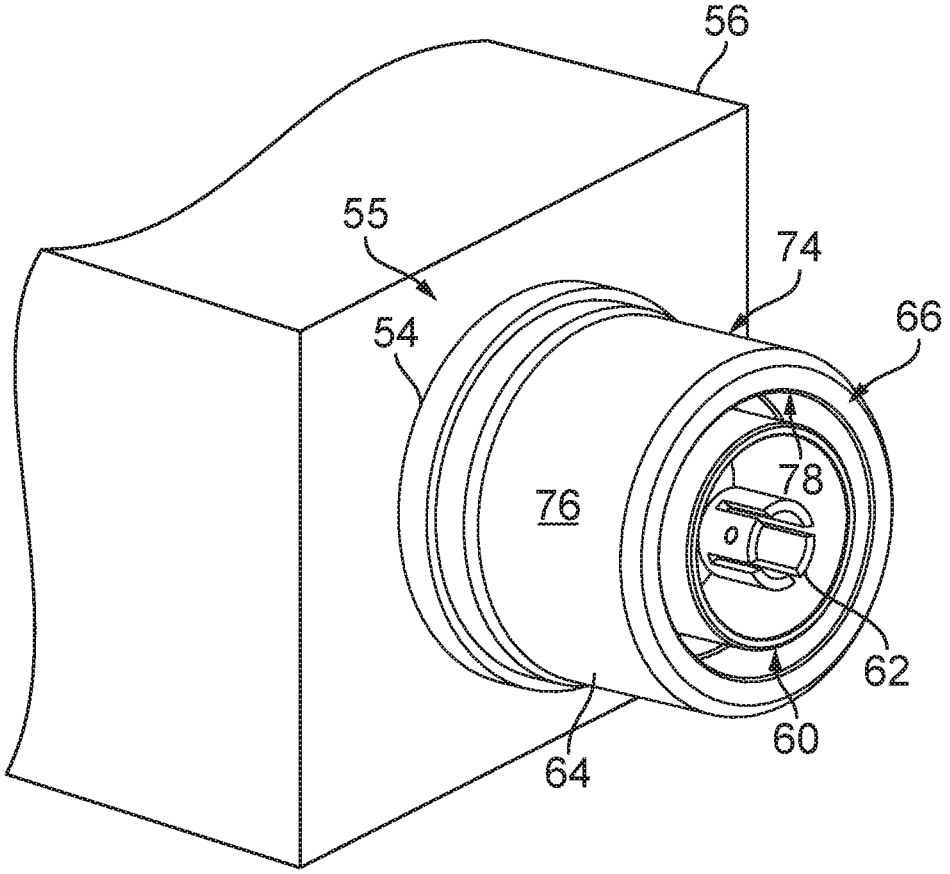

FIG. 7 is an isometric view of yet another embodiment of an interface port.

Figure 8:
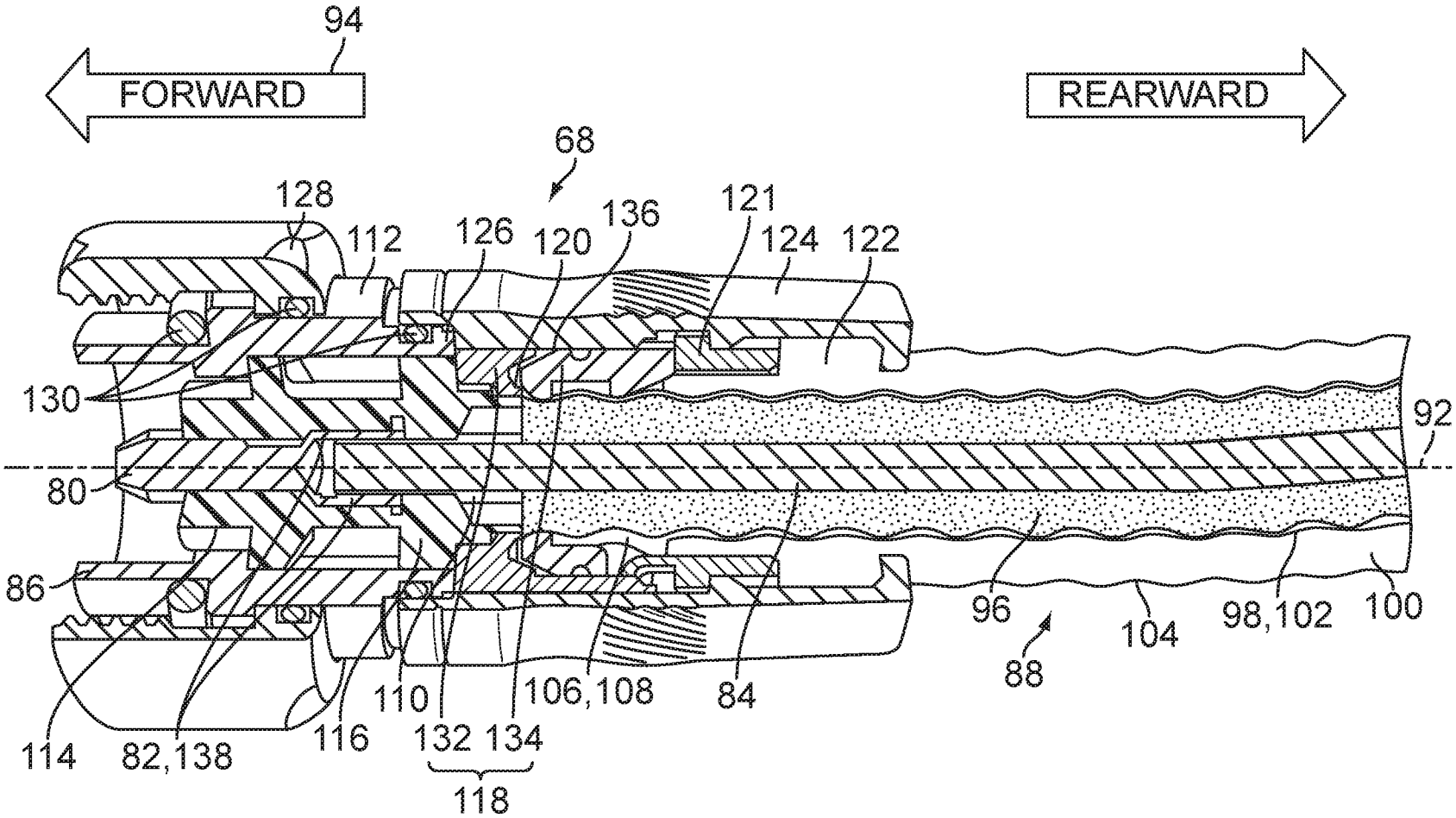

FIG. 8 is an isometric, cut-away view of one embodiment of a cable connector and cable.

Figure 9:
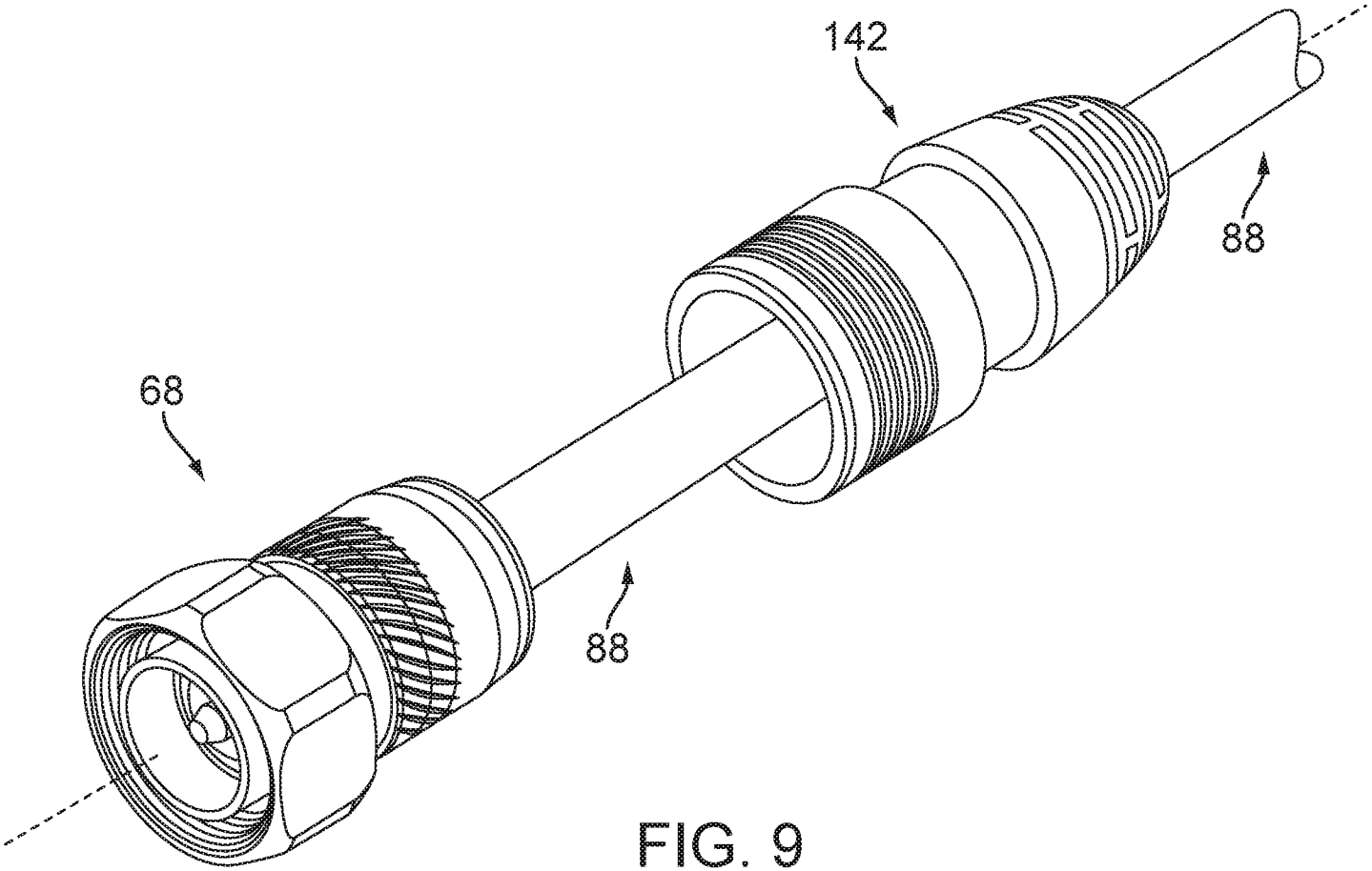

FIG. 9 is an isometric, exploded view of one embodiment of a cable assembly having a water resistant cover.

Figure 10:
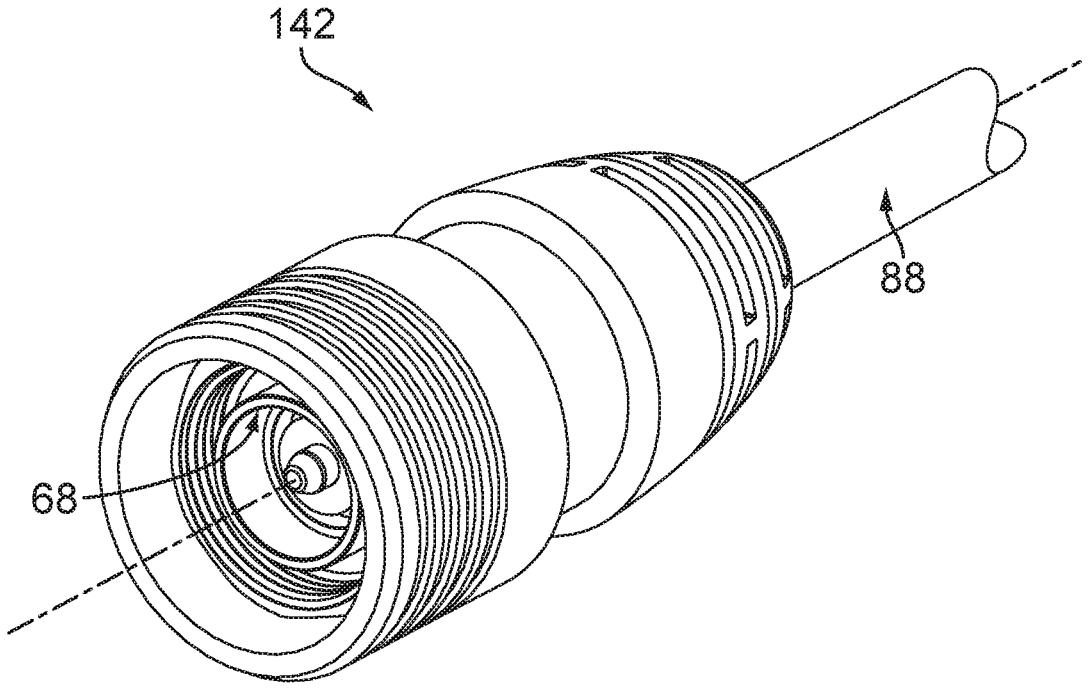

FIG. 10 is an isometric view of one embodiment of a cable connector covered by a water resistant cover.

Figure 11:
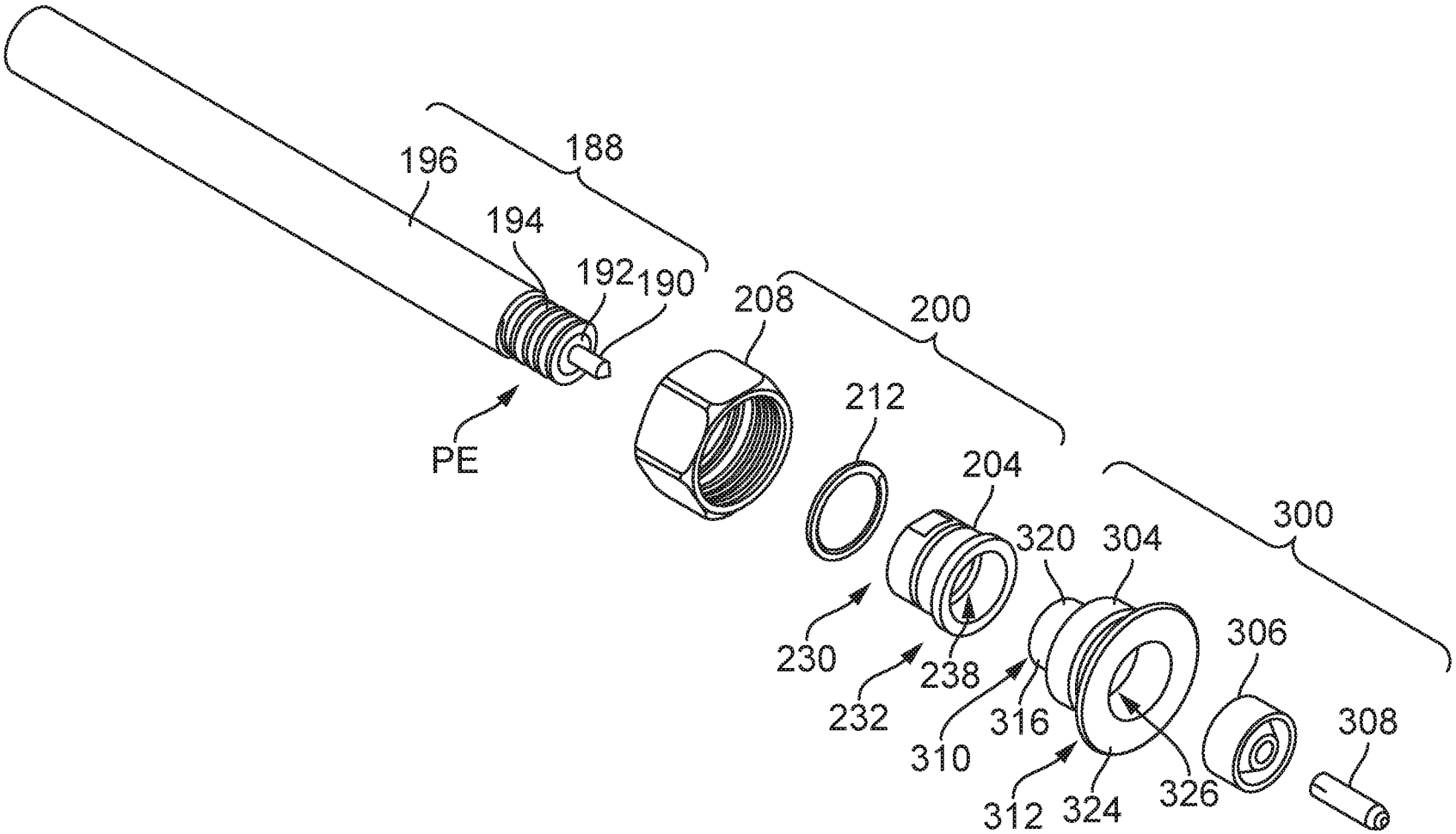

FIG. 11 is an exploded view of a hybrid feed-through connector for coaxial cables including a connector having a sleeve, a coupler and a retention member, the connector configured to cause an annular ring of a port body to compressively engage the outer conductor to biasingly maintain electrical contact with the interface port to ensure the maintenance of an electrical ground, even when the connector has become loose with respect to the interface port.

Figure 12:
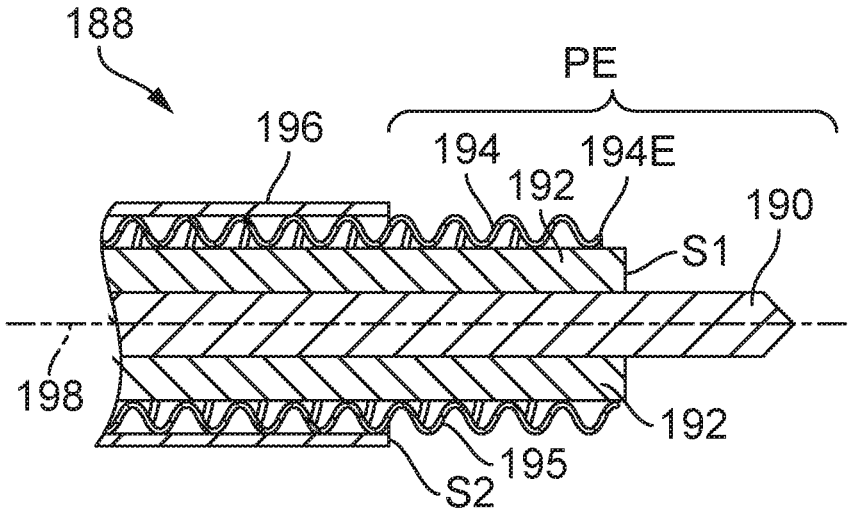

FIG. 12 is an enlarged view of a prepared end of a superflex coaxial cable.

Figure 13:
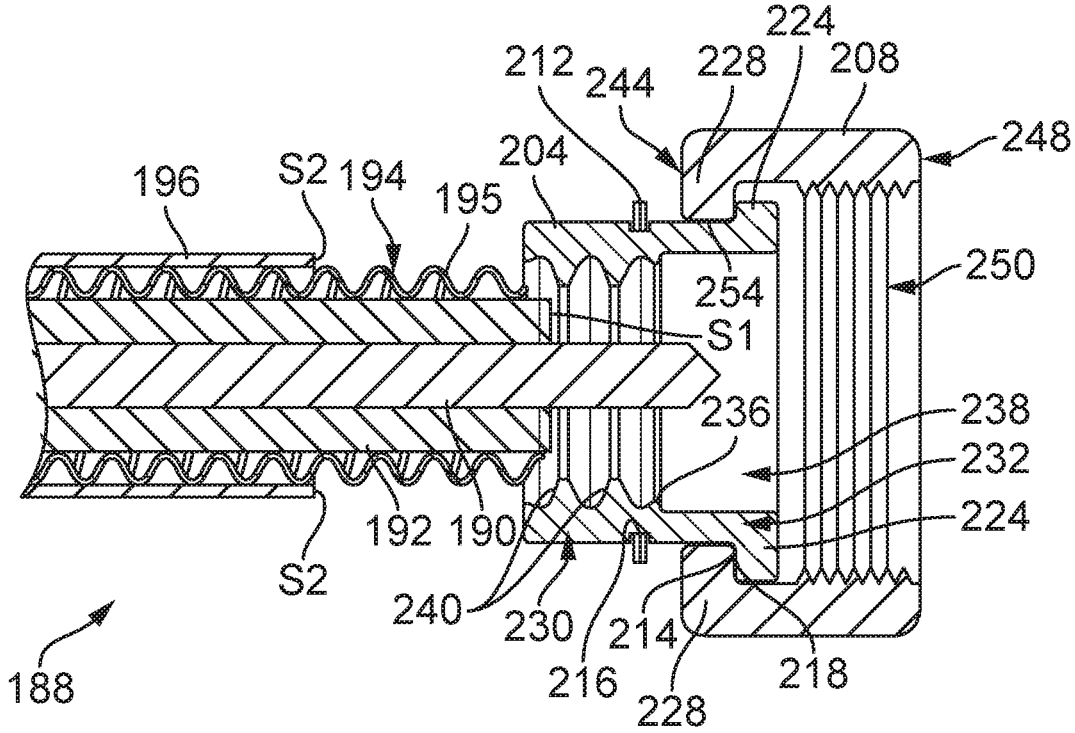

FIG. 13 depicts the coaxial cable in combination with the connector of the present disclosure.

Figure 14:
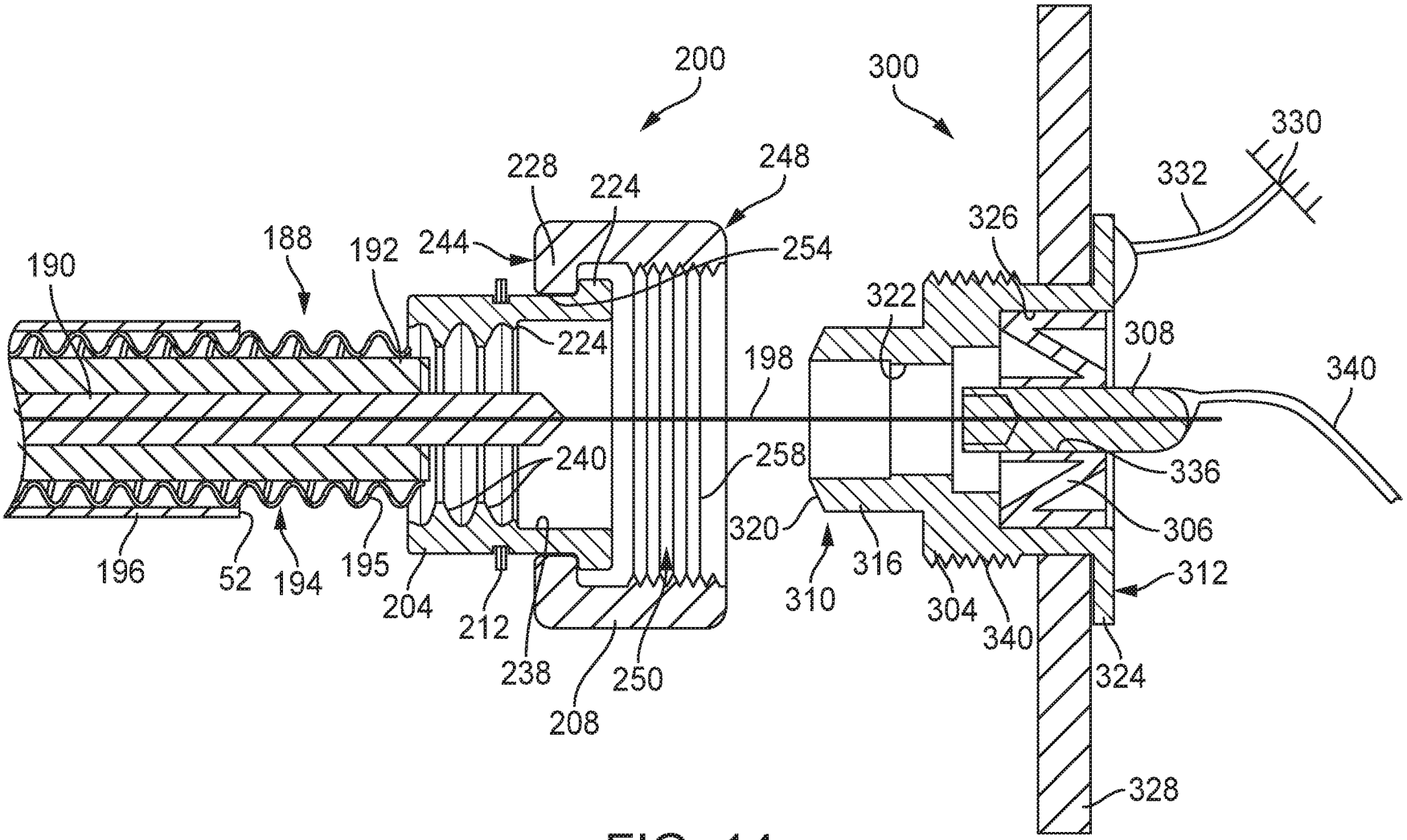

FIG. 14 depicts the coaxial cable, an interface port, and the connector of the present disclosure aligned for coupler with the coaxial cable to the interface port.

Figure 15:
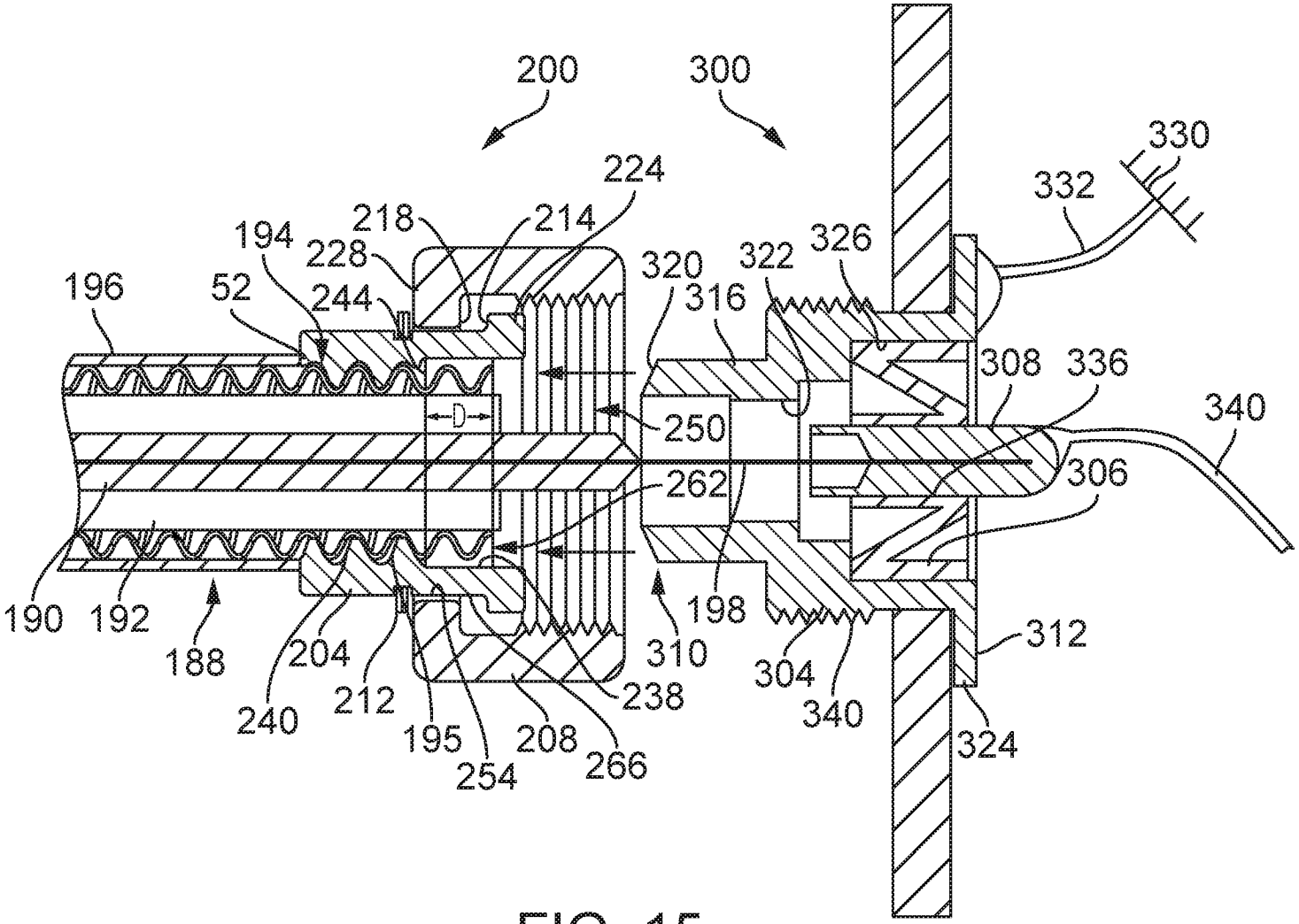

FIG. 15 depicts the connector of the present disclosure disposed in combination with the prepared end of the coaxial cable which have been prepared for connection to the coupler of the connector.

Figure 16:
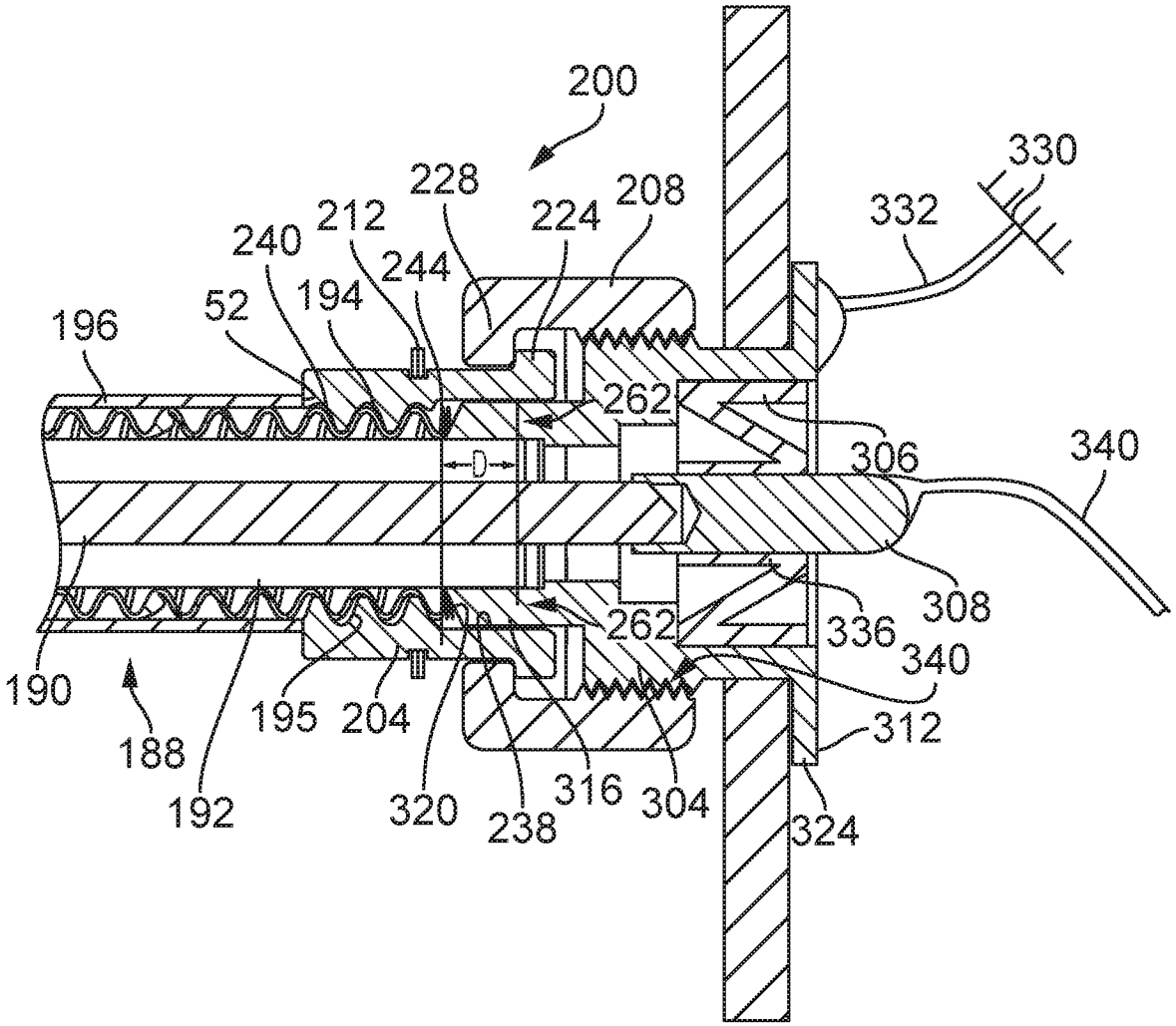

FIG. 16 depicts the connector of the present disclosure disposed in combination with both the prepared end of the coaxial cable and the interface port.

Figure 17:
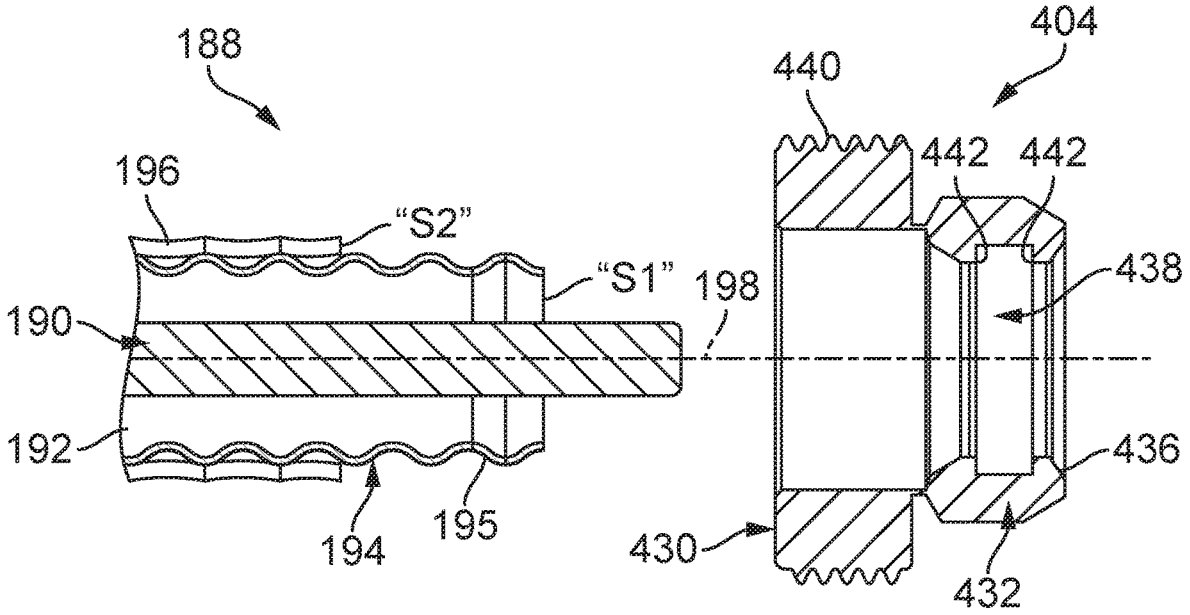

FIG. 17 depicts another embodiment of the present disclosure wherein a coupler threadably engages the sleeve to axially displace the coaxial cable toward an annular ring of the coupler and wherein the annular ring compressively engages the outer conductor to deform the outer conductor.

Figure 18:
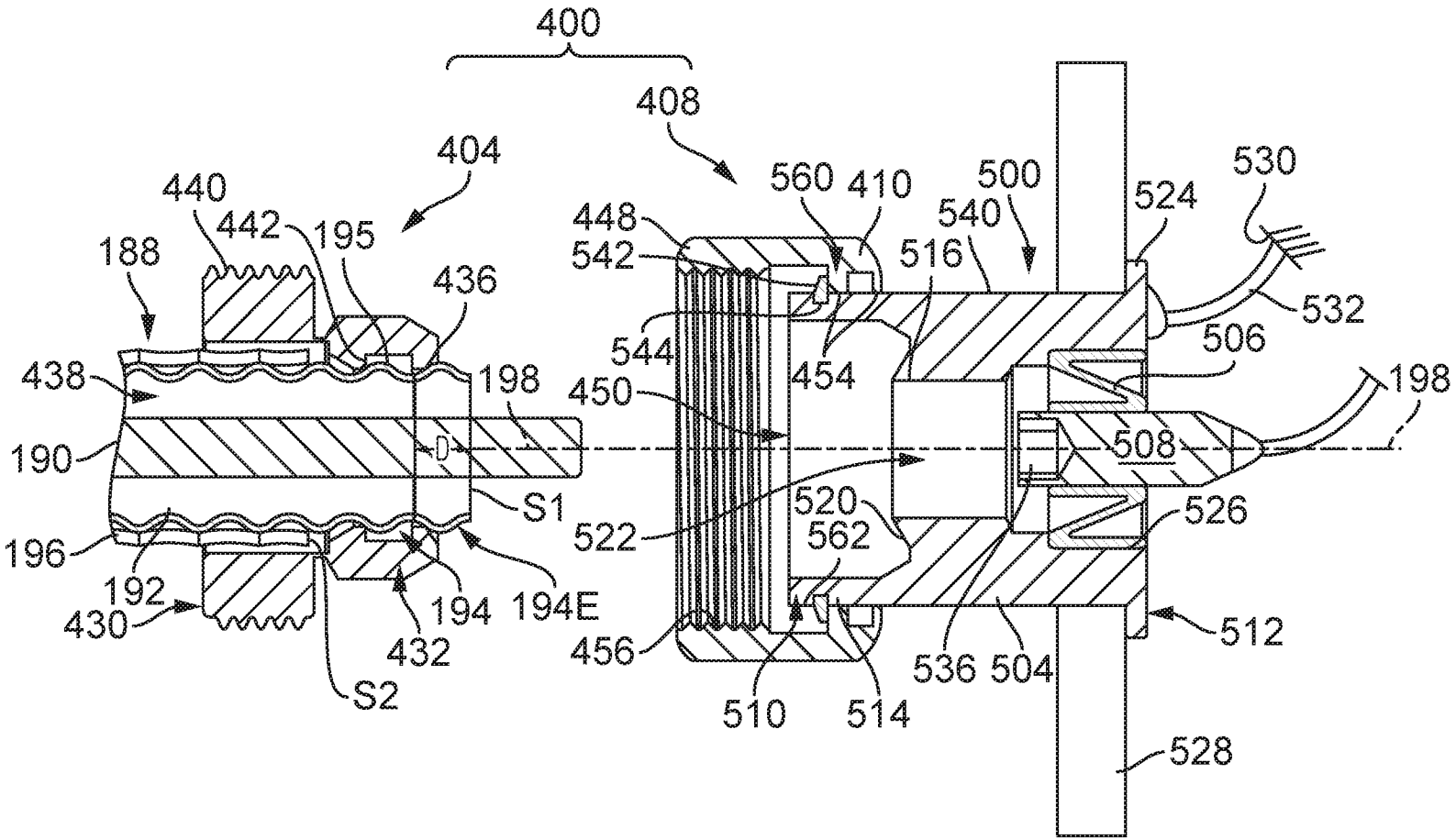

FIG. 18 depicts the prepared end of the cable disposed in opposed relation to an interface port having a port body mounted to a structural support.

Figure 19:
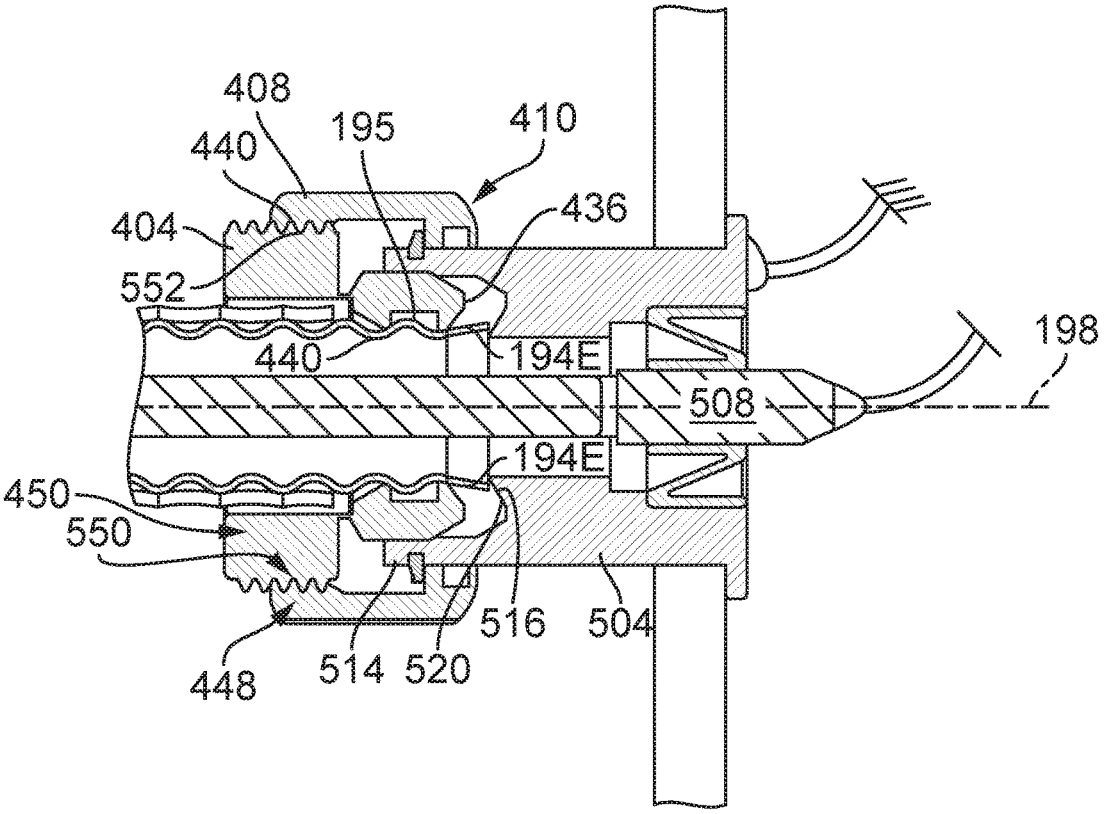
Figure 20:
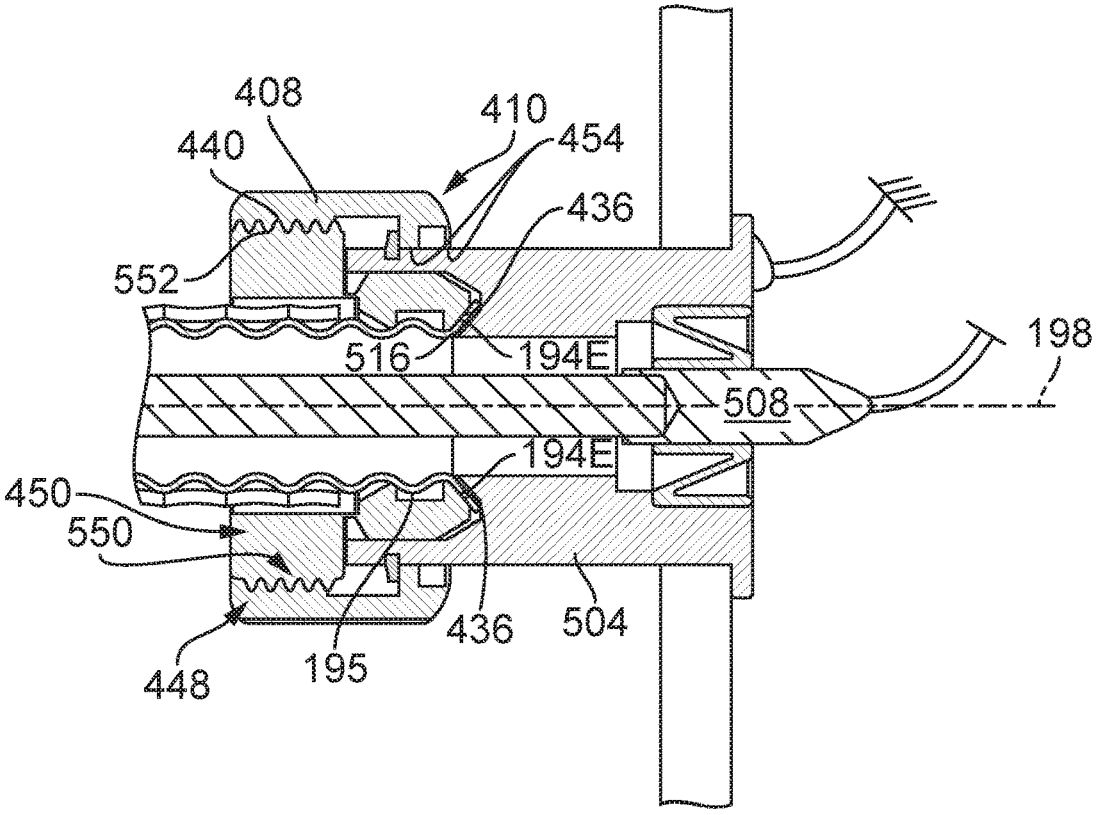

FIGS. 19 and 20 depict the connector coupling the prepared end of the coaxial cable to the interface port wherein FIG. 19 depicts shows the outer conductor immediately prior to being drawn into and against the port body and wherein FIG. 20 depicts the connector fully engaged, i.e., axially displaced against the port body, such that the outer conductor is compressed between an inner annular ring of the port body and the compression or abutment surface of the sleeve.

DETAILED DESCRIPTION

Overview—Wireless Communication Networks

In one embodiment, wireless communications employ a network switching subsystem ("NSS") which includes a circuit-switched core network for circuit-switched phone connections. The NSS also includes a service architecture which enables mobile networks, such as 2G, 3G and 4G mobile networks, to transmit Internet Protocol ("IP") packets to external networks such as the Internet. The service architecture enables mobile phones to have access to services such as Wireless Application Protocol ("WAP"), Multimedia Messaging Services ("MSSs") and the Internet.

A service provider or carrier operates a plurality of centralized mobile telephone switching offices ("MTSOs"). Each MTSO controls the base stations within a select region or cell surrounding the MTSO. The MTSOs also handle connections to the Internet and phone connections.

Referring to FIG. 1, an outdoor wireless communication network 2 includes a cell site or cellular base station 4. The base station 4, in conjunction with cellular tower 5, serves communication devices, such as mobile phones, in a defined area surrounding the base station 4. The cellular tower 5 also communicates with macro antennas 6 on the tops of buildings as well as micro antennas 8 mounted to, for example, street lamps 10.

The cell size depends upon the type of wireless network employed. For example, a macro cell can have a base station antenna installed on a tower or a building above the average rooftop level, such as the macro antennas 5 and 6. A micro cell can have an antenna installed at a height below the average rooftop level, often suitable for urban environments, such as the street lamp-mounted micro antenna 8. A picocell is a relatively small cell often suitable for indoor use.

As illustrated in FIG. 2, an indoor wireless communication network 12 includes an active distributed antenna system ("DAS") 14. The DAS 14 can, for example, be installed in a high rise commercial office building 16, a sports stadium 8 or a shopping mall. In one embodiment, the DAS 14 may include macro antennas 6 coupled to a radio frequency ("RF") repeater 20. The macro antennas 6 receive signals from a nearby base station while the RF repeater 20 amplifies and repeats the received signals. The RF repeater 20 is coupled to a DAS master unit 22 which, in turn, is coupled to a plurality of remote antenna units 24 distributed throughout the building 16. Depending upon the embodiment, the DAS master unit 22 can manage over one hundred remote antenna units 24 in a building. In operation, the master unit 22, as programmed and controlled by a DAS manager, is operable to control and manage the coverage and performance of the remote antenna units 24 based on the number of repeated signals fed by the repeater 20. It should be appreciated that a technician can remotely control the master unit 22 through a Local Area Network (LAN) connection or wireless modem.

Depending upon the embodiment, the RF repeater 20 can be an analog repeater that amplifies all received signals, or the digital RF repeater 20. In one embodiment, the digital repeater 20 includes a processor and a memory device or data storage device. The data storage device stores logic in the form of computer-readable instructions. The processor executes the logic to filter or clean the received signals before repeating the signals. In one embodiment, the digital repeater does not need to receive signals from an external antenna, but rather, has a built-in antenna located within its housing.

Base Stations

In one embodiment illustrated in FIG. 3, the base station 4 includes a tower 26 and a ground shelter 28 proximal to the tower 26. In this example, a plurality of exterior antennas 6 and remote radio heads 30 are mounted to the tower 26. The shelter 28 encloses base station equipment 32. Depending upon the embodiment, the base station equipment 32 includes electrical hardware operative to transmit and receive radio signals and encrypt and decrypt communications with the MTSO. The base station equipment 32 also includes power supply units and equipment for powering and controlling the antennas and other devices mounted to the tower 26.

In one embodiment, a distribution line 34, such as coaxial cable or fiber optic cable, distributes signals exchanged between the base station equipment 32 and the remote radio heads 30. Each remote radio head 30 is operatively coupled, and mounted adjacent, a group of associated macro antennas 6. Each remote radio head 30 manages the distribution of signals between its associated macro antennas 6 and the base station equipment 30. In one embodiment, the remote radio heads 30 extend the coverage and efficiency of the macro antennas 6. The remote radio heads 30, in one embodiment, have RF circuitry, analog-to-digital/digital-to-analog converters and up/down converters.

The antennas, such as macro antennas 6, micro antennas 8 and remote antenna units 24, are operable to receive signals from communication devices and send signals to the communication devices. Depending upon the embodiment, the antennas can be of different types, including, but not limited to, directional antennas, omni-directional antennas, isotropic antennas, dish-shaped antennas, and microwave antennas. Directional antennas can improve reception in higher traffic areas, along highways, and inside buildings like stadiums and arenas. Based upon applicable laws, a service provider may operate omni-directional cell tower signals up to a maximum power, such as 100 watts, while the service provider may operate directional cell tower signals up to a higher maximum of effective radiated power ("ERP"), such as 500 watts.

An omni-directional antenna is operable to radiate radio wave power uniformly in all directions in one plane. The radiation pattern can be similar to a doughnut shape where the antenna is at the center of the donut. The radial distance from the center represents the power radiated in that direction. The power radiated is maximum in horizontal directions, dropping to zero directly above and below the antenna.

An isotropic antenna is operable to radiate equal power in all directions and has a spherical radiation pattern. Omni-directional antennas, when properly mounted, can save energy in comparison to isotropic antennas. For example, since their radiation drops off with elevation angle, little radio energy is aimed into the sky or down toward the earth where it could be wasted. In contrast, isotropic antennas can waste such energy.

In one embodiment, the antenna has: (a) a transceiver moveably mounted to an antenna frame; (b) a transmitting data port, a receiving data port, or a transceiver data port; (c) an electrical unit having a PC board controller and motor; (d) a housing or enclosure that covers the electrical unit; and (e) a drive assembly or drive mechanism that couples the motor to the antenna frame. Depending upon the embodiment, the transceiver can be tiltably, pivotably or rotatably mounted to the antenna frame. One or more cables connect the antenna's electrical unit to the base station equipment 32 for providing electrical power and motor control signals to the antenna. A technician of a service provider can reposition the antenna by providing desired inputs using the base station equipment 32. For example, if the antenna has poor reception, the technician can remotely change the tilt angle of the antenna from the ground without having to climb up and manually reposition the antenna. As a consequence, an antenna motor drives the antenna frame to a desired tilt angle. Depending upon the embodiment, a technician can control the position of a moveable antenna from the base station, from a remote office or from a land vehicle by providing inputs over the Internet.

Data Interface Ports

Generally, the networks 2 and 12 include a plurality of network devices, including, but not limited to, the base station equipment 32, one or more radio heads 30, macro antennas 6, micro antennas 8, RF repeaters 20 and remote antenna units 24. As described above, these network devices include data interface ports which couple to connectors of signal-carrying cables, such as coaxial cables and fiber optic cables. In the example illustrated in FIG. 4, the tower 36 supports a radio head 38 and macro antenna 40. The radio head 38 has interface ports 42, 43 and 44 and the macro antenna 40 has antenna ports 45 and 47. In the example shown, the coaxial cable 48 is connected to the radio head interface port 42, while the coaxial cable jumpers 50 and 51 are connected to radio head interface ports 44 and 45, respectively. The coaxial cable jumpers 50 and 51 are also connected to antenna interface ports 45 and 47, respectively.

The interface ports of the networks 2 and 12 can have different shapes, sizes and surface types depending upon the embodiment. In one embodiment illustrated in FIG. 5, the interface port 52 has a tubular or cylindrical shape. The interface port 52 includes: (a) a forward end or base 54 configured to abut the network device enclosure, housing or wall 56 of a network device; (b) a coupler engager 58 configured to be engaged with a cable connector's coupler, such as a nut; (c) an electrical ground 60 received by the coupler engager 58; and (d) a signal carrier 62 received by the electrical grounder 60.

In the illustrated embodiment, the base 54 has a collar shape with a diameter larger than the diameter of the coupler engager 58. The coupler engager 58 is tubular in shape, has a threaded, outer surface 64 and a rearward end 66. The threaded outer surface 64 is configured to threadably mate with the threads of the coupler of a cable connector, such as connector 68 described below. In one embodiment illustrated in FIG. 6, the interface port 53 has a forward section 70 and a rearward section 72 of the coupler engager 58. The forward section 70 is threaded, and the rearward section 72 is non-threaded. In another embodiment illustrated in FIG. 7, the interface port 55 has a coupler engager 74. In this embodiment, the coupler engager 74 is the same as coupler engager 58 except that it has a non-threaded, outer surface 76 and a threaded, inner surface 78. The threaded, inner surface 78 is configured to be inserted into, and threadably engaged with, a cable connector.

Referring to FIGS. 5-8, in one embodiment, the signal carrier 62 is tubular and configured to receive a pin or inner conductor engager 80 of the cable connector 68. Depending upon the embodiment, the signal carrier 62 can have a plurality of fingers 82 which are spaced apart from each other about the perimeter of the signal carrier 80. When the cable inner conductor 84 is inserted into the signal carrier 80, the fingers 82 apply a radial, inward force to the inner conductor 84 to establish a physical and electrical connection with the inner conductor 84. The electrical connection enables data signals to be exchanged between the devices that are in communication with the interface port. In one embodiment, the electrical ground 60 is tubular and configured to mate with a connector ground 86 of the cable connector 68. The connector ground 86 extends an electrical ground path to the ground 64 as described below.

Cables

In one embodiment illustrated in FIGS. 4 and 8-10, the networks 2 and 12 include one or more types of coaxial cables 88. In the embodiment illustrated in FIG. 8, the coaxial cable 88 has: (a) a conductive, central wire, tube, strand or inner conductor 84 that extends along a longitudinal axis 92 in a forward direction F toward the interface port 56; (b) a cylindrical or tubular dielectric, or insulator 96 that receives and surrounds the inner conductor 84; (c) a conductive tube or outer conductor 98 that receives and surrounds the insulator 96; and (d) a sheath, sleeve or jacket 100 that receives and surrounds the outer conductor 98. In the illustrated embodiment, the outer conductor 98 is corrugated, having a spiral, exterior surface 102. The exterior surface 102 defines a plurality of peaks and valleys to facilitate flexing or bending of the cable 88 relative to the longitudinal axis 92.

To achieve the cable configuration shown in FIG. 8, an assembler/preparer, in one embodiment, takes one or more steps to prepare the cable 88 for attachment to the cable connector 68. In one example, the steps include: (a) removing a longitudinal section of the jacket 104 to expose the bare surface 106 of the outer conductor 108; (b) removing a longitudinal section of the outer conductor 108 and insulator 96 so that a protruding end 110 of the inner conductor 84 extends forward, beyond the recessed outer conductor 108 and the insulator 96, forming a step-shape at the end of the cable 88; (c) removing or coring-out a section of the recessed insulator 96 so that the forward-most end of the outer conductor 108 protrudes forward of the insulator 96.

In another embodiment not shown, the cables of the networks 2 and 12 include one or more types of fiber optic cables. Each fiber optic cable includes a group of elongated light signal guides or flexible tubes. Each tube is configured to distribute a light-based or optical data signal to the networks 2 and 12.

Connectors

In the embodiment illustrated in FIG. 8, the cable connector 68 includes: (a) a connector housing or connector body 112; (b) a connector insulator 114 received by, and housed within, the connector body 112; (c) the inner conductor engager 80 received by, and slidably positioned within, the connector insulator 114; (d) a driver 116 configured to axially drive the inner conductor engager 80 into the connector insulator 114 as described below; (e) an outer conductor clamp device or outer conductor clamp assembly 118 configured to clamp, sandwich, and lock onto the end section 120 of the outer conductor 106; (f) a clamp driver 121; (g) a tubular-shaped, deformable, environmental seal 122 that receives the jacket 104; (h) a compressor 124 that receives the seal 122, clamp driver 121, clamp assembly 118, and the rearward end 126 of the connector body 112; (i) a nut, fastener or coupler 128 that receives, and rotates relative to, the connector body 112; and (j) a plurality of O-rings or ring-shaped environmental seals 130. The environmental seals 122 and 130 are configured to deform under pressure so as to fill cavities to block the ingress of environmental elements, such as rain, snow, ice, salt, dust, debris and air pressure, into the connector 68.

In one embodiment, the clamp assembly 118 includes: (a) a supportive outer conductor engager 132 configured to be inserted into part of the outer conductor 106; and (b) a compressive outer conductor engager 134 configured to mate with the supportive outer conductor engager 132. During attachment of the connector 68 to the cable 88, the cable 88 is inserted into the central cavity of the connector 68. Next, a technician uses a hand-operated, or power, tool to hold the connector body 112 in place while axially pushing the compressor 124 in a forward direction F. For the purposes of establishing a frame of reference, the forward direction F is toward interface port 55 and the rearward direction R is away from the interface port 55.

The compressor 124 has an inner, tapered surface 136 defining a ramp and interlocks with the clamp driver 121. As the compressor 124 moves forward, the clamp driver 121 is urged forward which, in turn, pushes the compressive outer conductor engager 134 toward the supportive outer conductor engager 132. The engagers 132 and 134 sandwich the outer conductor end 120 positioned between the engagers 132 and 134. Also, as the compressor 124 moves forward, the tapered surface or ramp 136 applies an inward, radial force that compresses the engagers 132 and 134, establishing a lock onto the outer conductor end 120. Furthermore, the compressor 124 urges the driver 121 forward which, in turn, pushes the inner conductor engager 80 into the connector insulator 114.

The connector insulator 114 has an inner, tapered surface with a diameter less than the outer diameter of the mouth or grasp 138 of the inner conductor engager 80. When the driver 116 pushes the grasp 138 into the insulator 114, the diameter of the grasp 138 is decreased to apply a radial, inward force on the inner conductor 84 of the cable 88. As a consequence, a bite or lock is produced on the inner conductor 84.

After the cable connector 68 is attached to the cable 88, a technician or user can install the connector 68 onto an interface port, such as the interface port 52 illustrated in FIG. 5. In one example, the user screws the coupler 128 onto the port 52 until the fingers 140 of the signal carrier 62 receive, and make physical contact with, the inner conductor engager 80 and until the ground 60 engages, and makes physical contact with, the outer conductor engager 86. During operation, the non-conductive, connector insulator 114 and the non-conductive driver 116 serve as electrical barriers between the inner conductor engager 80 and the one or more electrical ground paths surrounding the inner conductor engager 80. As a result, the likelihood of an electrical short is mitigated, reduced or eliminated. One electrical ground path extends: (i) from the outer conductor 106 to the clamp assembly 118, (ii) from the conductive clamp assembly 118 to the conductive connector body 112, and (iii) from the conductive connector body 112 to the conductive ground 60. An additional or alternative electrical grounding path extends: (i) from the outer conductor 106 to the clamp assembly 118, (ii) from the conductive clamp assembly 118 to the conductive connector body 112, (iii) from the conductive connector body 112 to the conductive coupler 128, and (iv) from the conductive coupler 128 to the conductive ground 60.

These one or more grounding paths provide an outlet for electrical current resulting from magnetic radiation in the vicinity of the cable connector 88. For example, electrical equipment operating near the connector 68 can have electrical current resulting in magnetic fields, and the magnetic fields could interfere with the data signals flowing through the inner conductor 84. The grounded outer conductor 106 shields the inner conductor 84 from such potentially interfering magnetic fields. Also, the electrical current flowing through the inner conductor 84 can produce a magnetic field that can interfere with the proper function of electrical equipment near the cable 88. The grounded outer conductor 106 also shields such equipment from such potentially interfering magnetic fields.

The internal components of the connector 68 are compressed and interlocked in fixed positions under relatively high force. These interlocked, fixed positions reduce the likelihood of loose internal parts that can cause undesirable levels of passive intermodulation ("PIM") which, in turn, can impair the performance of electronic devices operating on the networks 2 and 12. PIM can occur when signals at two or more frequencies mix with each other in a non-linear manner to produce spurious signals. The spurious signals can interfere with, or otherwise disrupt, the proper operation of the electronic devices operating on the networks 2 and 12. Also, PIM can cause interfering RF signals that can disrupt communication between the electronic devices operating on the networks 2 and 12.

In one embodiment where the cables of the networks 2 and 12 include fiber optic cables, such cables include fiber optic cable connectors. The fiber optic cable connectors operatively couple the optic tubes to each other. This enables the distribution of light-based signals between different cables and between different network devices.

Supplemental Grounding

In one embodiment, grounding devices are mounted to towers such as the tower 36 illustrated in FIG. 4. For example, a grounding kit or grounding device can include a grounding wire and a cable fastener which fastens the grounding wire to the outer conductor 106 of the cable 88. The grounding device can also include: (a) a ground fastener which fastens the ground wire to a grounded part of the tower 36; and (b) a mount which, for example, mounts the grounding device to the tower 36. In operation, the grounding device provides an additional ground path for supplemental grounding of the cables 88.

Environmental Protection

In one embodiment, a protective boot or cover, such as the cover 142 illustrated in FIGS. 9-10, is configured to enclose part or all of the cable connector 88. In another embodiment, the cover 142 extends axially to cover the connector 68, the physical interface between the connector 68 and the interface port 52, and part or all of the interface port 52. The cover 142 provides an environmental seal to prevent the infiltration of environmental elements, such as rain, snow, ice, salt, dust, debris and air pressure, into the connector 68 and the interface port 52. Depending upon the embodiment, the cover 142 may have a suitable foldable, stretchable or flexible construction or characteristic. In one embodiment, the cover 142 may have a plurality of different inner diameters. Each diameter corresponds to a different diameter of the cable 88 or connector 68. As such, the inner surface of cover 142 conforms to, and physically engages, the outer surfaces of the cable 88 and the connector 68 to establish a tight environmental seal. The air-tight seal reduces cavities for the entry or accumulation of air, gas and environmental elements.

Materials

In one embodiment, the cable 88, connector 68 and interface ports 52, 53 and 55 have conductive components, such as the inner conductor 84, inner conductor engager 80, outer conductor 106, clamp assembly 118, connector body 112, coupler 128, ground 60 and the signal carrier 62. Such components are constructed of a conductive material suitable for electrical conductivity and, in the case of inner conductor 84 and inner conductor engager 80, data signal transmission. Depending upon the embodiment, such components can be constructed of a suitable metal or metal alloy including copper, but not limited to, copper-clad aluminum ("CCA"), copper-clad steel ("CCS") or silver-coated copper-clad steel ("SCCCS").

The flexible, compliant and deformable components, such as the jacket 104, environmental seals 122 and 130, and the cover 142 are, in one embodiment, constructed of a suitable, flexible material such as polyvinyl chloride (PVC), synthetic rubber, natural rubber or a silicon-based material. In one embodiment, the jacket 104 and cover 142 have a lead-free formulation including black-colored PVC and a sunlight resistant additive or sunlight resistant chemical structure. In one embodiment, the jacket 104 and cover 142 weatherize the cable 88 and connection interfaces by providing additional weather protective and durability enhancement characteristics. These characteristics enable the weatherized cable 88 to withstand degradation factors caused by outdoor exposure to weather.

Hybrid Feed-Through Connector

FIGS. 11 through 15 depict exploded and sectional views of the various components which combine to connect a coaxial cable to an interface port. In this embodiment, a superflex coaxial cable 188 is prepared for coupling to a connector 200 which, in turn, connects to an interface port 300. The superflex coaxial cable 188 includes an inner conductor 190, an outer conductor 194, and insulating dielectric core 192 disposed therebetween. Furthermore, the outer conductor 194 is covered by a compliant or elastomer outer jacket 196.

Similar to the manner previously described, the coaxial cable 188 is stripped in a stepped fashion at predefined locations along the elongate axis 198 of the cable 188. The inner conductor 190 projects beyond a first step S1 formed by the outer conductor 194 and the insulating dielectric core 192. Additionally, a second step S2 is produced by the outer jacket 196 which is stripped back from the outer conductor 194.

While a superflex cable 188 is depicted, it should be appreciated that the invention is applicable to any conductive outer connector. In the described embodiment, the superflex cable 188 defines a corrugated, or spiral-shaped, outer conductor which facilitates deformation in an axial direction, i.e., in response to an axial force imposed along the elongate axis 198 of the coaxial cable 188. Specifically, the corrugations or spiral-shape outer conductor 194 facilitate accordion deformation thereof in response to the imposed axial force.

In FIGS. 11 and 14, the connector 200 couples the prepared superflex coaxial cable 188 to the interface port 300, and comprises: a conductive port body 304, an inner conductor engager 308 and a centering member 306 insulating the inner conductor engager 308 from the conductive port body 304. In the described embodiment, the centering member 306 has a Z-shaped cross-sectional shape to allow for a degree of transverse displacement, i.e., in a direction transverse to the elongate axis 198 of the coaxial cable 188. Furthermore, the port body 304 defines a first connector end 310 and a second grounding end 312. The first end 310 includes: (i) an annular ring 316 projecting rearwardly toward the coaxial cable 188, (ii) an annular compression surface 320 at the terminal end of the annular ring 316, and (iii) a central bore 322 extending from the first to the second ends 310, 312. The annular ring 316 projects axially forward toward the coaxial cable 188 while the annular compression surface 320 is shaped in the form of a conical frustum or, alternatively, a convex shape. As will be discussed in greater detail hereinafter, the shape of the annular surface 320 impacts the way the outer conductor 194 conforms to, or complements, the annular surface 320 and the efficacy of the electrical connection therebetween. Finally, the central bore 322 receives the insulating dielectric core 192 and the inner conductor 190 of the coaxial cable 188.

The second end 312 of the port body 304 defines an outwardly projecting flange 324 and a mounting cavity 326. The outwardly projecting flange 324 facilitates mounting to an RF device or to a conductive panel 328. In the described embodiment, electrical continuity between the port 300 and electrical ground 330 is established by an electrical lead 332 soldered to the flange 324. Alternatively, the conductive panel 328 may be connected to electrical ground such that the contact interface between the flange 324 and the conductive panel 328 provides an electrical path to ground. The port mounting cavity 326 supports the inner conductor engager 308 by supporting and centering the Z-shaped centering member 306. Specifically, the Z-shaped centering member 306 seats within a cylindrical bore of the cavity 326 which, in turn defines an aperture 336 disposed within the inner conductor engager 308 for mounting the inner conductor 190 of the coaxial cable 188. In the described embodiment, electrical continuity between the inner conductor engager 308 and the RF device (not shown) is established by an electrical lead 340 soldered to the inner conductor engager 308.

Finally, the port body 304 comprises an exterior mounting surface 340 disposed between the first and second ends 310, 312 which facilitates mounting to the connector 200. The mounting surface 340 may be threaded to threadably engage the connector 200 and axially draw the coaxial cable 188 toward the port body 304 in response to rotation of the connector 200. Alternatively, the mounting surface 340 may include any interlocking surfaces, e.g., spring tabs or cam surfaces, operative to effect axial displacement of the coaxial cable 188 in response to rotation of the connector 200 about the elongate axis 198.

In FIGS. 11, 12 and 13, the connector 200 is operative to mechanically and electrically couple the coaxial cable 188 to the interface port 300. Specifically, the connector 200 includes a sleeve 204, a coupler 208 and a retention member 212 operative to axially retain the coupler 208 to the sleeve 204. The sleeve 204 and coupler 208 are rotationally mounted along a mating interface defined by radially projecting inwardly and outwardly projecting shoulders 214, 218 associated with the sleeve 204 and coupler 208, respectively. In the described embodiment, the radial inwardly and outwardly projecting shoulders 214, 218 are formed by opposing inwardly and outwardly projecting flanges 224, 228 of the sleeve 204 and the coupler 208, respectively.

The sleeve 204 includes an aft end 230, a forward end 232, and a bore 238 extending between the aft and forward ends 230, 232. The bore 238 receives the prepared end PE of the coaxial cable 188 and is configured to engage an exterior surface 195 of the outer conductor 194 of a coaxial cable 188 such that a terminal end 194E of the outer conductor 194 extends beyond the abutment shoulder 236 by a threshold dimension D. More specifically, the sleeve 204 abuts the second step S2 defined by the stripped end of the outer jacket 196 and includes an inner surface 240, i.e., along the surface of the bore 238, having a contour which complements the corrugated spiral outer surface 195 of the outer conductor 194. As such, the complementary inner surface 240 couples the sleeve 204 to the outer conductor 194 such that rotational displacement of the sleeve 204 effects axial displacement of the outer conductor 194. That is, since the surface 195 of the outer conductor 194 has a spiral configuration, the surface 195 functions similarly to threads on a shaft wherein as the spiral inner surface 240 of the sleeve 204 engages the spiral surface 195 of the outer conductor 194, the rotational displacement of the inner surface 240 either effects: (i) axial displacement of the cable 188 or (ii) axial displacement of the sleeve 204 until the sleeve 204 abuts the second step S2 of the outer jacket 196.

The coupler 208 defines an aft end 244, a forward end 248 defining a coupler cavity 250, and a bore 254 extending between the aft end 244 and the coupler cavity 250. As described above, the aft end 244 of the coupler 208 is configured to rotationally and axially engage the forward end 232 of the sleeve 204 such that rotation of the coupler 208 effects relative axial displacement of the sleeve 204 and the coupler 208. While the described features include opposing flanges 224, 228 to facilitate rotation while enabling axial displacement, it will be appreciated that other structural configurations may be equally effective to perform this function. Accordingly, the disclosure is not limited to the embodiments illustrated herein.

In the described embodiment, a C-shaped retention ring 212 is disposed in an annular groove 216 to retain the coupler 208 relative to the sleeve 204 during normal use and handling. That is, the retention ring 212 allows the coupler 208 to be positioned in a first location or axial position relative to the port body 304, i.e., by backing the coupler 208 against the retention ring 212, and drawing the coaxial cable 188 toward the port body 304 to a second position, i.e., by threadably engaging the threads 340 of the port body 304.

In FIGS. 13 and 14, the coupler cavity 250 is configured to engage the interface port body 304 such that relative axial displacement of the sleeve 204 and the coupler 208 causes the annular surface 320 of the interface port body 304 to compressively engage the terminal end 194E of the outer conductor 194. More specifically, the coupler cavity 250 may include a plurality of female threads 258 for threadably engaging the exterior male threads 340 of the port body 304. As the coupler 208 rotates about the elongate axis 198, the opposing flanges 224, 228 draw the sleeve 204 toward the interface port body 304. Inasmuch as the complementary interior corrugated surface 240 of the sleeve 204 mechanically and frictionally engages the outer conductor surface 195 of the outer conductor 194, the coaxial cable 188 is also drawn toward the interface port body 304.

Referring to FIGS. 15 and 16, as the prepared end PE of the coaxial cable 188 is drawn toward the conductive port body 304, the annular ring 316 thereof is received within the annular cavity 262 formed between the bore 238 of the sleeve 204 and the dielectric core of the coaxial cable 188. As the threaded interface continues to draw the annular ring 316 into the annular cavity 262, the annular surface 320 of the annular ring 316 compressively engages the outer conductor 194 to axially deform the corrugations of the outer conductor 194. The relative displacement of the interface port body 304 and the coupler 208 cause the annular surface 320 to engage, and axially deform, the outer conductor 194. As a result, an electrical ground is effected from the outer conductor 194 to the port body 304 while, at the same time, securing a reliable connection between an RF signal-carrying inner conductor 190 and the inner conductor engager 308 of the interface port 300. In the described embodiment, the connector of annular surface 320 of the interface port body 304 defines a radial thickness dimension from a radially inboard edge of the annular surface to a radially outboard edge thereof. To ensure a reliable electrical ground, the outer conductor 194 defines a corrugation thickness, i.e., from a peak to a valley/trough, the radial thickness dimension is substantially equal to the corrugation thickness.

Once imposed, the compressive force develops a biasing feature which is maintained even after rotation of the coupler 208 is discontinued. That is, the accordion configuration of the outer conductor 194 continues to impose an axial bias such that should the coupler 208 loosen, the axial bias maintains electrical contact, and a positive electrical ground between the outer conductor 194 and the interface port body 304. Consequently, the configuration defined herein has similar characteristics to connectors boasting constant biasing features wherein connectors maintain electrical continuity even when the connector has loosened.

In another embodiment depicted in FIGS. 17 and 18, the connector 400 includes a sleeve 404 disposed in combination with the prepared end PE of the coaxial cable 188 and a coupler 408 disposed in combination with a hybrid interface port 500. The prepared end PE of the coaxial cable 188 includes an inner conductor 190, an outer conductor 194, and insulating dielectric core 192 disposed therebetween. Furthermore, the outer conductor 194 is covered by a compliant or elastomer outer jacket 196. As described supra, the coaxial cable 188 is stripped in a stepped fashion at predefined locations along the elongate axis 198 of the cable 188 and the inner conductor 190 projects beyond a first step S1 formed by the outer conductor 194 and the insulating dielectric core 192. Additionally, a second step S2 is produced by the outer jacket 196 which is stripped back from the outer conductor 194.

The connector 400 couples the prepared coaxial cable 188 to the hybrid interface port 500 and comprises: a conductive port body 504, an inner conductor engager 508 and a Z-shaped centering member 506 insulating the inner conductor engager 508 from the conductive port body 504. In the described embodiment, the port body 504 defines a first connector end 510 and a second grounding end 512. The first connector end 510 includes: (i) an outer annular ring 514, (ii) and inner annular ring 516, (iii) an annular compression surface 520 at the terminal end of the annular ring 516, and (iii) a central bore 522 extending from the first to the second connector ends 510, 512. The outer and inner annular rings 514, 516 project axially forward toward the coaxial cable 188 while the annular compression surface 520 is shaped in the form of a conical frustum or, alternatively, defines an arcuate, or concave shape. As will be discussed in greater detail hereinafter, the shape of the annular surface 520 impacts the way the outer conductor 194 conforms to, or compliments, the annular compression surface 520 and the efficacy of the electrical connection made therebetween. Finally, the central bore 522 receives the insulating dielectric core 192 and the inner conductor 190 of the coaxial cable 188.

The second end 512 of the port body 504 defines an outwardly projecting flange 524 and an internal mounting cavity 526. The outwardly projecting flange 524 facilitates mounting to an RF device or to a conductive panel 528. In the described embodiment, electrical continuity between the port 500 and electrical ground 530 is established by an electrical lead 532 soldered to the flange 524. Alternatively, the conductive panel 528 may be connected to electrical ground 530 such that the contact interface between the flange 524 and the conductive panel 528 provides an electrical path to ground. The port mounting cavity 526 supports the inner conductor engager 508 by supporting and centering the Z-shaped centering member 506. Specifically, the Z-shaped centering member 506 seats within a cylindrical bore of the cavity 526 which, in turn defines an aperture 536 disposed within the inner conductor engager 508 for mounting the inner conductor 190 of the coaxial cable 188. In the described embodiment, electrical continuity between the inner conductor engager 508 and the RF device (not shown) is established by an electrical lead 540 soldered to the inner conductor engager 508.

Finally, the port body 504 comprises an exterior mounting surface 540 disposed between the first and connectors second ends 510, 512 which slidably mounts to an aft or inboard end 410 of the coupler 408. In this embodiment, the coupler 408 rotationally and telescopically mounts along the exterior mounting surface 540 and is retained by a conventional C-shaped retention ring 542 which is disposed within an annular groove 544.

In FIGS. 17-20, the connector 400 is operative to mechanically and electrically couple the coaxial cable 188 to the hybrid interface port 500. As described in a preceding paragraphs and similar to the embodiment depicted in FIGS. 12-16, the connector 400 includes the sleeve 404, the coupler 408 and the retention member 542. In this embodiment, however, the retention member 542 is operative to axially retain the coupler 408 relative to the port body 504 rather than the sleeve 404. Accordingly, in one embodiment, the coupler 208 (shown in FIG. 14) is rotationally and slideably mounted to the sleeve 204 while, in another embodiment (shown in FIG. 18,) the coupler 408 is rotationally and slideably mounted to the port body 504.

The sleeve 404 includes an aft end 430, a forward end 432 defining an abutment shoulder 436, and a bore 438 extending between the aft and forward ends 430, 432. The bore 438 receives the prepared end PE of the coaxial cable 188 and is configured to engage an exterior surface 195 of the outer conductor 194 of a coaxial cable 188. Specifically, the exterior surface 195 of the outer conductor 194 extends beyond the abutment shoulder 436 such that a terminal end 194E of the outer conductor 194 extends beyond the abutment shoulder 236 by a threshold dimension D (FIG. 18).

More specifically, the sleeve 404 abuts the second step S2 defined by the stripped end of the outer jacket 196 and includes an inner surface 442, i.e., along the surface of the bore 438, having a contour which engages the corrugated spiral outer surface 195 of the outer conductor 194. As such, the inner surface 442 couples the sleeve 404 to the outer conductor 194 such that axial displacement of the sleeve 404 effects axial displacement of the outer conductor 194.

In the described embodiment, the sleeve and coupler 404, 408 define a coupler interface 440 (FIGS. 19 and 20) operative to axially draw the coaxial cable 188 toward the port body 504 in response to rotation of the coupler 408 about the elongate axis 198. The sleeve 404 may include a plurality of male threads 440 operative to engage the plurality of female threads 552 formed within the cavity 522 of the coupler 408. Alternatively, the coupler interface 440 may include any interlocking surfaces, e.g., spring tabs and cam surfaces, operative to effect axial displacement of the coaxial cable 188 in response to rotation of the coupler 408 about the elongate axis 198.

The coupler 408 defines an aft or inboard end 410, a forward or outboard end 448 defining an coupler cavity 450, and a bore 454 (FIG. 20) extending between the aft end 410 and the coupler cavity 450. As described above, the aft end 410 of the coupler 408 is configured to rotationally and axially engage the forward end of the port body 504. Specifically, rotation of the coupler 408 effects axial displacement of the sleeve 404 relative to the port body 504 while an inwardly projecting flange 560 engages the retention ring 542 to capture the coupler 408 on the port body 504. While a variety of configurations may be employed to facilitate rotation while retaining the axial position of the rotating element, it will be appreciated that other structural configurations may be equally effective at performing these functions. Accordingly, the disclosure is not limited to the embodiments illustrated herein.

In FIGS. 19 and 20, the coupler 408 is configured to engage the interface port body 504 to effect axial displacement of the sleeve 404 relative to the interface port body 504. Operationally, the sleeve 404 receives the prepared end PE of the coaxial cable 188 through the bore 438 of the sleeve 404. The coaxial cable 188 extends through the bore 438 such that an end portion of the outer conductor 194 extends past the abutment shoulder 436 by a threshold dimension D. The inner or bore surface 438 engages the corrugations of the outer conductor 194 such that as the coupler interface 550 is drawn toward the sleeve 404, the annular surface 520 of the port body 504 compressively deforms the terminal end 194E of the outer conductor 194. That is, the inner annular ring 516 axially engages the terminal end 194E to produce a grounding path for electrical current. Once imposed, the compressive force develops a biasing force which is maintained even after rotation of the coupler 508 is discontinued. That is, the accordion configuration of the outer conductor 194 imposes an axial bias which continues such that should the coupler 508 loosen, the axial bias continues to maintain electrical contact, and a positive electrical ground between the outer conductor 194 and the interface port body 504.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. A connector operative to mechanically and electrically couple a coaxial cable to an interface port, the coaxial cable having an inner conductor, an outer conductor, and a dielectric core disposed therebetween and electrically insulating one of the conductors from the other conductor, the outer conductor configured to facilitate axial deformation in response to an axial force imposed along an elongate axis of the coaxial cable, the interface port comprising:

a port body defining a port cavity, a threaded outer surface and an annular ring projecting from a first end of the port body and defining an annular surface;

an inner conductor engager at least partially disposed within the port cavity, and a centering member configured to retain and center the inner conductor engager within the port cavity, and a connector including:

a sleeve defining a bore configured to receive the coaxial cable, the sleeve furthermore configured to engage the outer conductor thereof at one end and having an outwardly projecting flange at the other end; and a coupler defining a coupler cavity having a threaded inner surface, and an inwardly projecting coupler flange disposed at one end, the coupler flange defining an aperture configured to receive the coaxial cable, and a retention member configured to capture the coupler between first and second axial positions relative to a connector sleeve, wherein the coupler threadably engages the port body along the threaded inner and outer surfaces, respectively, such that during rotation of the coupler from the first position to the second position, the sleeve engages and imposes an axial force on the outer conductor of the coaxial cable to simultaneously, feed a tip end pin of the inner conductor into a socket of the compression surface to engage and axially deform the outer conductor thereby effecting an annular ring of the port body is received in the coupler cavity and the relative displacement of the port body and the coupler causes the annular compression surface to engage and axially deform the outer conductor thereby effecting an electrical ground from the outer conductor to the port body;

wherein the annular compression surface of the interface port defines a radial thickness dimension from a radially inboard edge of the annular surface to a radially outboard edge thereof, and wherein the outer conductor defines a corrugation thickness, and wherein the radial thickness dimension is substantially equal to the corrugation thickness; wherein the sleeve further comprises an annular groove spaced away from an outwardly projecting shoulder of the sleeve and a C-shaped retention ring disposed in the annular groove.

2. The connector of claim 1 wherein the annular surface of the interface port is frustoconical in shape.

3. The connector of claim 1 wherein a cross-section of the annular compression surface defines a convex shape.

4. A connector to mechanically and electrically couple a coaxial cable to an interface port, comprising:

a sleeve defining an aft end, a forward end defining an abutment shoulder, and a bore extending between the aft and forward ends, the bore configured to engage an exterior surface of an outer conductor of a coaxial cable such that a terminal end of the outer conductor extends beyond the abutment shoulder by a threshold dimension; and a coupler defining an aft end, a forward end defining a coupler cavity, and a bore extending between the aft and forward ends of the coupler cavity, the aft end of the coupler configured to rotationally and axially engage the forward end of the sleeve such that: (i) rotation of the coupler effects relative axial displacement of the sleeve and the interface port, and (ii) axial displacement of the sleeve and the interface port causes an annular surface of the interface port to compressively engage the terminal end of the outer conductor to effect an electrical ground from the outer conductor to the interface port;

wherein the annular compression surface of the interface port defines a radial thickness dimension from a radially inboard edge of the annular compression surface to a radially outboard edge thereof, and wherein the outer conductor defines a corrugation thickness, and wherein the radial thickness dimension is substantially equal to the corrugation thickness;

wherein the sleeve further comprises an annular groove spaced away from an outwardly projecting shoulder of the sleeve and a C-shaped retention ring disposed in the annular groove.

5. The connector of claim 4 wherein the coupler and a port body of the interface port define a threaded interface therebetween and wherein rotation of the coupler effects relative axial displacement of the outer conductor and the interface port.

6. The connector of claim 4 wherein the relative axial displacement of the sleeve and coupler causes an inner conductor pin of the coaxial cable to engage a socket of the interface port.

7. The connector of claim 4 wherein the sleeve and coupler define outwardly and inwardly projecting shoulders, respectively, the shoulders defining a rotational interface permitting rotational displacement between the sleeve and the coupler.

8. The connector of claim 4 wherein the outer conductor defines a spiral corrugation, and wherein upon engagement, the spiral corrugation of the outer conductor effects a spring bias force tending to maintain an electrically biasing force between the annular surface of the interface port and the outer conductor.

9. The connector of claim 4 wherein the sleeve includes a spiral groove configured to engage a spiral-shaped outer surface of the outer conductor, the spiral groove frictionally and mechanically engaging the outer surface to draw the coaxial cable axially toward the interface port and beyond an internal abutment shoulder of the sleeve.

10. The connector of claim 4 wherein the outer conductor is configured to accordion upon compressive engagement by the annular surface of the interface port.

* * * * *